US011209767B2

(12) United States Patent
Ishio et al.

(10) Patent No.: US 11,209,767 B2
(45) Date of Patent: Dec. 28, 2021

(54) IMAGE-FORMING APPARATUS

(71) Applicant: CANON KABUSHIKI KAISHA, Tokyo (JP)

(72) Inventors: Shohei Ishio, Tokyo (JP); Keisuke Ishizumi, Kanagawa (JP); Shinji Katagiri, Kanagawa (JP); Wataru Takahashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/210,035

(22) Filed: Mar. 23, 2021

(65) Prior Publication Data

US 2021/0302901 A1 Sep. 30, 2021

(30) Foreign Application Priority Data

Mar. 30, 2020 (JP) ..... JP2020-060757

(51) Int. Cl.
*G03G 21/00* (2006.01)
*G03G 15/16* (2006.01)

(52) U.S. Cl.
CPC ..... *G03G 21/0017* (2013.01); *G03G 15/162* (2013.01)

(58) Field of Classification Search
CPC ..... G03G 21/0017; G03G 15/162; G03G 15/161; G03G 2215/1657
See application file for complete search history.

(56) References Cited

U.S. PATENT DOCUMENTS

2015/0177653 A1* 6/2015 Seki ..... G03G 15/161 399/101
2019/0332040 A1* 10/2019 Yokoyama ..... G03G 15/162
2019/0369529 A1* 12/2019 Yagi ..... G03G 15/162

FOREIGN PATENT DOCUMENTS

JP H1063027 A 3/1998
JP 2016186581 A 10/2016
JP 2019045583 A 3/2019
JP 2019211774 A 12/2019

* cited by examiner

*Primary Examiner* — Sandra Brase
(74) *Attorney, Agent, or Firm* — Canon U.S.A., Inc., IP Division

(57) ABSTRACT

Toner contains toner base particles and an organosilicon polymer on the surface of the toner base particles, and silica particles are added to the toner as an external additive. The surface roughness Rz of an intermediate transfer belt, against which a blade abuts, in the width direction of the intermediate transfer belt perpendicular to the belt conveying direction is larger than the average particle diameter Ry of the organosilicon polymer and is smaller than the average particle diameter Rk of the silica particles.

12 Claims, 12 Drawing Sheets

IMAGE-FORMING APPARATUS

BACKGROUND OF THE INVENTION

Field of the Invention

The present disclosure relates to an electrophotographic image-forming apparatus, such as a laser printer, a copying machine, or a facsimile machine.

Description of the Related Art

In an electrophotographic color-image-forming apparatus, an intermediate transfer system has been known in which a toner image is successively transferred from an image-forming portion of each color to an intermediate transfer member, and the toner images are entirely transferred from the intermediate transfer member to a transfer material.

In such an image-forming apparatus, the image-forming portion of each color has a drum-shaped photosensitive member (hereinafter referred to as a photosensitive drum) as an image-bearing member. The intermediate transfer member is typically an intermediate transfer belt formed of an endless belt. A toner image formed on the photosensitive drum of each image-forming portion is primarily transferred to an intermediate transfer belt by applying a voltage from a primary transfer power supply to a primary transfer member facing the photosensitive drum with the intermediate transfer belt interposed therebetween. The color toner images primarily transferred from the image-forming portion of each color to the intermediate transfer belt are entirely secondarily transferred from the intermediate transfer belt to a transfer material, such as a paper or OHP sheet, by applying a voltage from a secondary transfer power supply to a secondary transfer member in a secondary transfer portion. The color toner images transferred to the transfer material are then fixed to the transfer material by fixing means.

In an image-forming apparatus of the intermediate transfer system, toner remains on an intermediate transfer belt (untransferred toner) after toner images are secondarily transferred from the intermediate transfer belt to a transfer material. Thus, the untransferred toner remaining on the intermediate transfer belt must be removed before a toner image corresponding to another image is primarily transferred to the intermediate transfer belt.

Untransferred toner is typically removed by a blade cleaning system. In the blade cleaning system, untransferred toner is scraped off with a cleaning blade and is collected in a cleaner case. The cleaning blade is located downstream of the secondary transfer portion in the movement direction of the intermediate transfer belt and abuts as a contact member against the intermediate transfer belt. The cleaning blade is typically made of an elastomer, such as a urethane rubber. The cleaning blade is often arranged such that an edge of the cleaning blade is pressed against the intermediate transfer belt in a direction (counter direction) opposite to the movement direction of the intermediate transfer belt.

Japanese Patent Laid-Open No. 10-63027 (Patent Literature 1) discloses that fine particles externally added to toner that is supplied to a photosensitive drum are dispersed between the photosensitive drum and a toner image to reduce the force acting between the photosensitive drum and the toner, thereby improving transfer efficiency.

However, the following disadvantages may occur when the fine particles disclosed in Patent Literature 1 are transferred from the photosensitive drum to the intermediate transfer belt and reach a blade nip portion where the intermediate transfer belt abuts against a cleaning blade. That is, the fine particles may pass through a very small space in the blade nip portion, and the fine particles, for example, made of hard particles, such as silica, passing through the blade nip portion may scrape the surface of the cleaning blade. Toner may pass through the scraped portion of the cleaning blade and cause faulty cleaning.

SUMMARY OF THE INVENTION

The present disclosure improves toner transfer efficiency and reduces the occurrence of faulty cleaning when residual toner on a belt is collected by a cleaning blade that abuts against the belt.

An image-forming apparatus according to the present disclosure includes an image-bearing member configured to bear a toner image, a developing device, which includes a storage portion configured to accommodate toner and a developing member configured to develop a latent image formed on the image-bearing member with the toner, a movable endless belt facing the image-bearing member, and a collecting device with a cleaning blade that can abut against the belt and with which residual toner on the belt can be collected, wherein the toner accommodated in the developing device contains toner base particles and an organosilicon polymer on a surface of the toner base particles, an external additive included in toner in the storage portion, is configured to move together with the toner from the developing member toward the image-bearing member, and a surface roughness of an outer peripheral surface of the belt against which the cleaning blade abuts, is larger than an average particle diameter of the organosilicon polymer, and is smaller than an average particle diameter of the external additive.

Further features of the present disclosure will become apparent from the following description of exemplary embodiments with reference to the attached drawings.

DESCRIPTION OF THE EMBODIMENTS

Exemplary embodiments of the present disclosure are described below with reference to the accompanying drawings. The dimensions, materials, shapes, and relative arrangement of the components described in these exemplary embodiments should be appropriately changed according to the configuration of the apparatus to which the present disclosure is applied and other conditions, and the scope of the present disclosure is not limited to these embodiments.

Exemplary Embodiment 1

[Image-Forming Apparatus]

Figure 1:
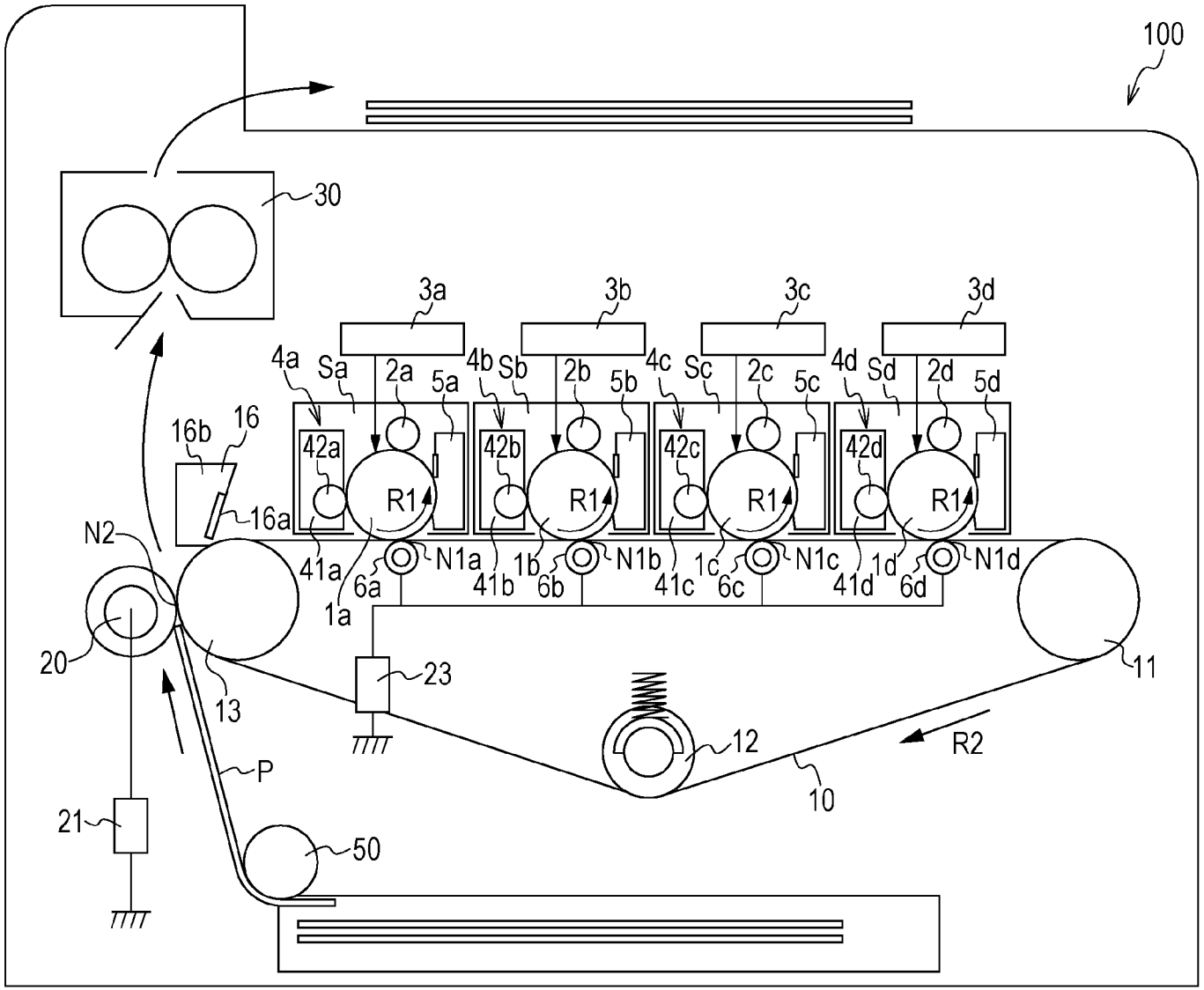
FIG. 1 is a schematic cross-sectional view of an image-forming apparatus.

FIG. 1 is a schematic cross-sectional view of an image-forming apparatus 100 according to the present exemplary embodiment. The image-forming apparatus 100 according to the present exemplary embodiment is a tandem type image-forming apparatus including a plurality of image-forming portions Sa to Sd. A first image-forming portion Sa forms an image with a yellow (Y) toner, a second image-forming portion Sb forms an image with a magenta (M) toner, a third image-forming portion Sc forms an image with a cyan (C) toner, and a fourth image-forming portion Sd forms an image with a black (Bk) toner. These four image-forming portions are arranged in a row at regular intervals, and the configuration of each image-forming portion is substantially the same except for the color of toner accommodated therein. Thus, the image-forming apparatus 100 according to the present exemplary embodiment is described below with respect to the first image-forming portion Sa, and the second image-forming portion Sb, the third image-forming portion Sc, and the fourth image-forming portion Sd having the same configuration as the first image-forming portion Sa are not described here.

The first image-forming portion Sa includes a photosensitive drum 1*a*, which is a drum-shaped photosensitive member, a charging roller 2*a*, which is a charging member, a developing device 4*a*, and a drum cleaning member 5*a*.

The photosensitive drum 1*a* is an image-bearing member configured to bear a toner image and is rotationally driven at a predetermined process speed (200 mm/s in the present exemplary embodiment) in the direction of the arrow R1 illustrated in the drawing. The developing device 4*a* includes a developing container 41*a* (storage portion) configured to accommodate a yellow toner, and a development roller 42*a* (developing member), which is a developing member configured to bear the yellow toner accommodated in the developing container 41*a* and to develop a yellow toner image on the photosensitive drum 1*a*. The drum cleaning member 5*a* is a member for collecting toner on the photosensitive drum 1*a*. The drum cleaning member 5*a* includes a cleaning blade, which comes into contact with the photosensitive drum 1*a*, and a waste toner box configured to accommodate toner removed from the photosensitive drum 1*a* by the cleaning blade.

When a controller (not shown) receives an image signal and starts image-forming operation, the photosensitive drum 1*a* is rotationally driven. In the rotation process, the photosensitive drum 1*a* is uniformly charged to a predetermined electric potential (charging potential) with a predetermined polarity (negative polarity in the present exemplary embodiment) by the charging roller 2*a* and is exposed to light emitted from an exposure device 3*a* in accordance with an image signal. This forms an electrostatic latent image corresponding to a yellow component image of a target color image. The electrostatic latent image is then developed by the developing device 4*a* at the development position and is visualized as a yellow toner image (hereinafter referred to simply as a toner image). The normal charge polarity of the toner accommodated in the developing device 4*a* is negative polarity. In the present exemplary embodiment, the electrostatic latent image is reverse-developed with toner charged with the same polarity as the charge polarity of the photosensitive drum by the charging member. The present disclosure, however, can also be applied to an image-forming apparatus in which an electrostatic latent image is positively developed with toner charged with polarity opposite to the charge polarity of the photosensitive drum.

An intermediate transfer belt 10, which is an endless movable intermediate transfer member, abuts against the photosensitive drums 1*a* to 1*d* of the image-forming portions Sa to Sd and is stretched by three shafts of a support roller 11, a stretching roller 12, and an opposed roller 13, which are stretching members. The intermediate transfer belt 10 is stretched at a tension of 60 N by the stretching roller 12 and is moved in the direction of the arrow R2 in the drawing as the opposed roller 13 is rotated by a driving force. The intermediate transfer belt 10 in the present exemplary embodiment is composed of a plurality of layers and is described in detail later.

While passing through a primary transfer portion N1*a* where the photosensitive drum 1*a* comes into contact with the intermediate transfer belt 10, a toner image formed on the photosensitive drum 1*a* is primarily transferred to the intermediate transfer belt 10 by applying a positive voltage from a primary transfer power supply 23 to a primary transfer roller 6*a*. Subsequently, residual toner on the photosensitive drum 1*a*, which is not primarily transferred to the intermediate transfer belt 10, is collected by the drum cleaning member 5*a* and is removed from the surface of the photosensitive drum 1*a*.

The primary transfer roller 6*a* is a primary transfer member (contact member) facing the photosensitive drum 1*a* via the intermediate transfer belt 10 and is in contact with the inner peripheral surface of the intermediate transfer belt 10. The primary transfer power supply 23 is a power supply that can apply a positive or negative voltage to primary transfer rollers 6*a* to 6*d*. In the present exemplary embodiment, a voltage is applied from the common primary transfer power supply 23 to a plurality of primary transfer members. The present disclosure, however, is not limited to the present exemplary embodiment and can also be applied to a configuration in which a primary transfer power supply is provided for each primary transfer member.

In the same manner, a second magenta toner image, a third cyan toner image, and a fourth black toner image are formed and are successively transferred to the intermediate transfer belt 10. Thus, four color toner images corresponding to the target color image are formed on the intermediate transfer belt 10. While passing through the secondary transfer portion in which a secondary transfer roller 20 comes into contact with the intermediate transfer belt 10, the four color toner images on the intermediate transfer belt 10 are entirely secondarily transferred to the surface of the transfer material P, such as a paper or OHP sheet, fed by the sheet feeder 50.

The secondary transfer roller 20 (secondary transfer member) is a nickel-plated steel bar 8 mm in outer diameter covered with a foam sponge with a volume resistivity of $10^8$ Ω·cm and a thickness of 5 mm composed mainly of NBR and epichlorohydrin rubber and has an outer diameter of 18 mm. The foam sponge had a rubber hardness of 30° at a load of 500 g as measured with an Asker durometer type C. The secondary transfer roller 20 is in contact with the outer peripheral surface of the intermediate transfer belt 10, is pressed at a pressure of 50 N against the opposed roller 13 facing the secondary transfer roller 20 via the intermediate transfer belt 10, and constitutes a secondary transfer portion N2.

The secondary transfer roller 20 is driven to rotate with the intermediate transfer belt 10. When a voltage is applied by a secondary transfer power supply 21, an electric current flows from the secondary transfer roller 20 toward the opposed roller 13. Thus, the toner image on the intermediate transfer belt 10 is secondarily transferred to the transfer material P in the secondary transfer portion. When the toner image on the intermediate transfer belt 10 is secondarily transferred to the transfer material P, the voltage applied from the secondary transfer power supply 21 to the secondary transfer roller 20 is controlled such that a constant electric current flows from the secondary transfer roller 20 to the opposed roller 13 via the intermediate transfer belt 10. The electric current for the secondary transfer is determined in advance according to the environment surrounding the image-forming apparatus 100 and the type of the transfer material P. The secondary transfer power supply 21 is coupled to the secondary transfer roller 20 and applies a transfer voltage to the secondary transfer roller 20. The secondary transfer power supply 21 can output a voltage in the range of 100 to 4000 V.

The transfer material P to which the four color toner images have been transferred in the secondary transfer is then heated and pressed by a fixing device 30, and the four color toners are melted, mixed, and fixed to the transfer material P. Residual toner (untransferred toner) on the intermediate transfer belt 10 after the secondary transfer is cleaned and removed by a belt cleaning device 16 (collecting device) located downstream of the secondary transfer portion N2 in the movement direction of the intermediate transfer belt 10 (hereinafter referred to as a belt conveying direction). The belt cleaning device 16 includes a cleaning blade 16*a* (contact member), which can abut against the outer peripheral surface of the intermediate transfer belt 10 at a position facing the opposed roller 13, and a cleaner case 16*b* configured to accommodate toner collected by the cleaning blade 16*a*. In the following description, the cleaning blade 16*a* is simply referred to as the blade 16*a*.

The image-forming apparatus 100 according to the present exemplary embodiment forms a full-color print image through the above operation.

[Intermediate Transfer Belt]

Figure 2:
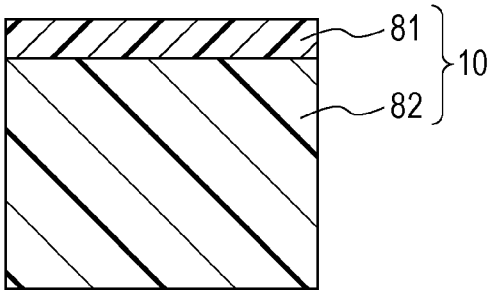
FIG. 2 is a schematic view of an intermediate transfer belt according to an exemplary embodiment 1.

FIG. 2 is a schematic cross-sectional view of the intermediate transfer belt 10 in the present exemplary embodiment. The intermediate transfer belt 10 in the present exemplary embodiment has a circumferential length of 700 mm and a longitudinal width of 250 mm and is composed of a base layer 82 and a surface layer 81, as illustrated in FIG. 2. The base layer refers to the thickest layer in the thickness direction of the intermediate transfer belt 10 (in a direction perpendicular to the belt conveying direction and the width direction of the intermediate transfer belt 10, which is perpendicular to the belt conveying direction). The surface layer 81 is a layer closer to the photosensitive drums 1*a* to 1*d* than the primary transfer rollers 6*a* to 6*d* in the thickness direction of the intermediate transfer belt 10, that is, a layer formed on the outer peripheral surface of the intermediate transfer belt 10.

The base layer 82 of the intermediate transfer (endless) belt 10 has a thickness of 80 μm and is formed of poly (ethylene naphthalate) (PEN) resin mixed with an ion conductive agent serving as a conductive agent. The base layer 82 is ion conductive and electroconductive due to ion transfer between polymer chains. Thus, although the resistance value of the base layer 82 fluctuates with the temperature and humidity of the atmosphere, the resistance value is highly uniform in the circumferential direction. In the present exemplary embodiment, the base layer 82 had a volume resistivity of $1\times10^8$ Ω·cm or less. The volume resistivity was measured with Hiresta-UP (MCP-HT450) manufactured by Mitsubishi Chemical Corporation equipped with a ring probe type UR (model MCP-HTP12). The volume resistivity was measured at room temperature (23° C.), at a humidity of 50%, and at an applied voltage of 100 V for 10 seconds.

The surface layer 81 of the intermediate transfer belt 10 is formed of an acrylic resin and is formed on the outer peripheral surface of the intermediate transfer belt 10 by applying the acrylic resin to the base layer 82. In the present exemplary embodiment, the surface layer 81 has a thickness of 3 μm.

The surface layer 81 relates to the surface roughness of the intermediate transfer belt 10, as described later, and can therefore be uniformly formed on the surface of the base layer 82 to improve smoothness. More specifically, the acrylic resin may be applied to the entire surface of the base layer 82 by spray coating for a certain period or may be applied from a ring-shaped nozzle to the entire surface of the base layer 82 of the cylindrical intermediate transfer belt 10. In the present exemplary embodiment, the surface layer 81 was formed by spraying a curable resin over the surface of the base layer 82 and irradiating the curable resin with an energy beam, such as ultraviolet light.

[Belt Cleaning Device]

Figure 3A:
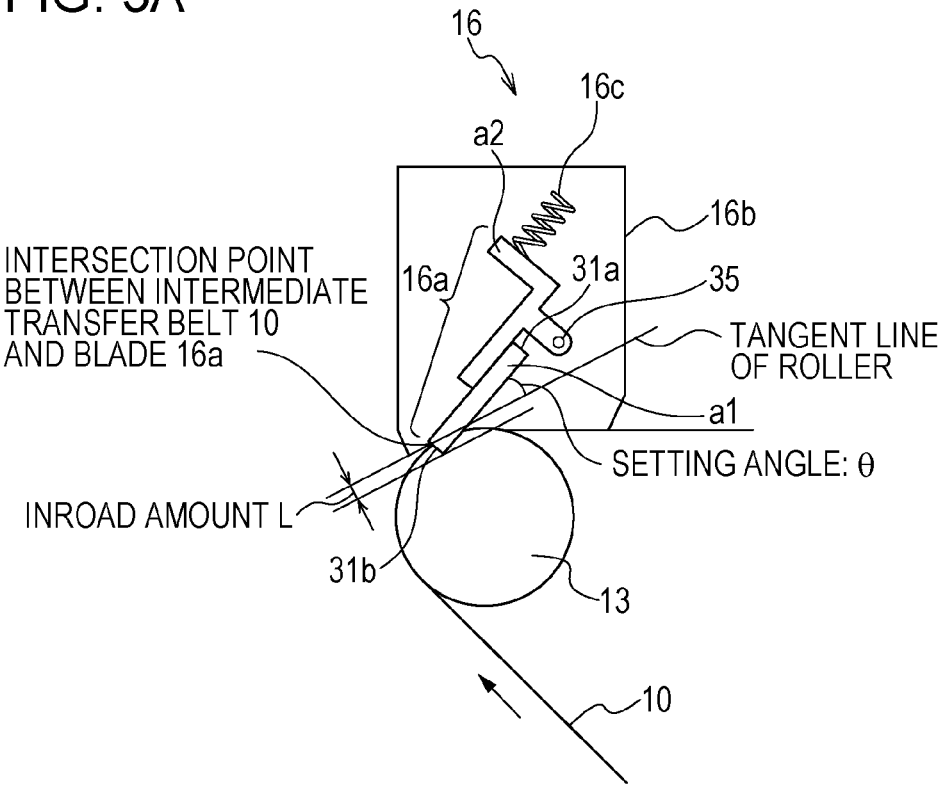
FIGS. 3A and 3B are schematic views of the cleaning member in the exemplary embodiment 1.
Figure 3B:
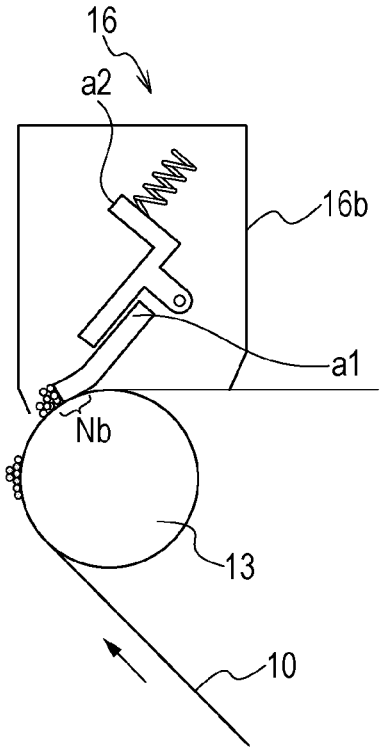

The structure of the belt cleaning device 16 is described below. FIG. 3A is a virtual cross-sectional view of the mounting position of the blade 16*a* when the blade 16*a* is not elastically deformed. FIG. 3B is a schematic cross-sectional view of the state of an elastically deformed blade 16*a* when residual toner on the surface of the intermediate transfer belt 10 is collected by the belt cleaning device 16.

The belt cleaning device 16 includes the cleaner case 16*b* and the blade 16*a* in the cleaner case 16*b*. The cleaner case 16*b* constitutes a housing of an intermediate transfer unit (not shown) including the intermediate transfer belt 10. The blade 16*a* has an elastic portion a1, which abuts against the intermediate transfer belt 10, and a supporting member a2 for supporting the elastic portion a1. The elastic portion a1 is made of a urethane rubber (polyurethane), which is an elastic material, and is bonded to and supported by the supporting member a2 formed of a sheet metal made of a plated steel sheet.

The blade 16*a* is a plate-like member that is long in the width direction of the intermediate transfer belt 10 (the longitudinal direction of the blade 16*a*) crossing the belt conveying direction. The elastic portion a1 in the transverse direction has a free end 31*b*, which abuts against the intermediate transfer belt 10, and a fixed end 31*a*, which is bonded and fixed to the supporting member a2. The elastic portion a1 has a longitudinal length of 245 mm, a thickness of 2.5 mm, and a hardness of 77 according to JIS K 6253 standard.

The blade 16*a* is pivotable with respect to the surface of the intermediate transfer belt 10. More specifically, the supporting member a2 is pivotably supported with respect to the surface of the intermediate transfer belt 10 via a pivotal shaft 35 fixed to the cleaner case 16*b*. When the supporting member a2 is pressed by a pressurizing spring 16*c* serving as an urging member provided in the cleaner case 16*b*, the blade 16*a* rotates on the pivotal shaft 35. Consequently, the free end 31*b* of the blade 16*a* is urged (pressed) against the intermediate transfer belt 10.

Facing the blade 16*a*, the opposed roller 13 is located on the inner peripheral side of the intermediate transfer belt 10. The blade 16*a* abuts against the surface of the intermediate transfer belt 10 in a direction opposite to the belt conveying direction at a position facing the opposed roller 13. Thus, the blade 16*a* abuts against the surface of the intermediate transfer belt 10 such that the free end 31*b* in the transverse direction faces upstream in the belt conveying direction. Thus, as illustrated in FIG. 3B, a blade nip portion Nb is formed between the blade 16*a* and the intermediate transfer belt 10. Untransferred toner is scraped by the blade 16*a* from the surface of the moving intermediate transfer belt 10 in the blade nip portion Nb and is collected in the cleaner case 16*b*.

In the present exemplary embodiment, the blade 16*a* is mounted as described below. As illustrated in FIG. 3A, the setting angle θ is 20 degrees, and the inroad amount L is 2.0 mm. The setting angle θ is an angle of the blade 16*a* (more specifically, a surface of the blade 16*a* approximately perpendicular to the thickness direction of the blade 16*a*) with respect to a tangent line of the opposed roller 13 at an intersection point between the intermediate transfer belt 10 and the blade 16*a* (more specifically, the free end of the blade 16*a*). The inroad amount L is an overlap length in the thickness direction between the blade 16*a* and the opposed roller 13. The contact pressure is defined as a pressing force (a linear pressure in the longitudinal direction) of the blade 16*a* in the blade nip portion Nb and is measured with a film pressure measuring system (trade name: PINCH, manufactured by Nitta Corporation). Such setting can reduce the curling or slip noise of the blade 16*a* in a high-temperature and high-humidity environment and achieve high cleaning performance. Such setting can also suppress faulty cleaning in a low-temperature and low-humidity environment and achieve high cleaning performance.

Urethane rubbers and synthetic resins generally have high frictional resistance while sliding, and the blade 16*a* is likely to curl initially. Thus, an initial lubricant, such as graphite fluoride, may be applied to the free end 31*b* of the blade 16*a* in advance.

The rubber hardness of the blade 16*a* is appropriately determined for the material of the intermediate transfer belt 10 and is preferably 70 or more and 80 or less according to JIS K 6253 standard. A rubber hardness lower than this range may result in an increased abrasion loss during use and lower durability. A rubber hardness higher than the range may result in decreased elastic force and chipping due to friction with the intermediate transfer belt 10. The rubber hardness of the blade 16*a* is appropriately determined for the material of the intermediate transfer belt 10.

[Toner]

The toner used in the present exemplary embodiment is described below.

The toner in the present exemplary embodiment has protrusions containing an organosilicon polymer on the surface of toner particles. The protrusions are in surface contact with the surface of toner base particles. The surface contact can be rightly expected to suppress the movement, separation, and burying of the protrusions. A cross-sectional observation of the toner was performed with a scanning transmission electron microscope (STEM) to determine the degree of surface contact. FIGS. 4 to 7 are schematic views of the protrusions on the toner particles.

Figure 4:
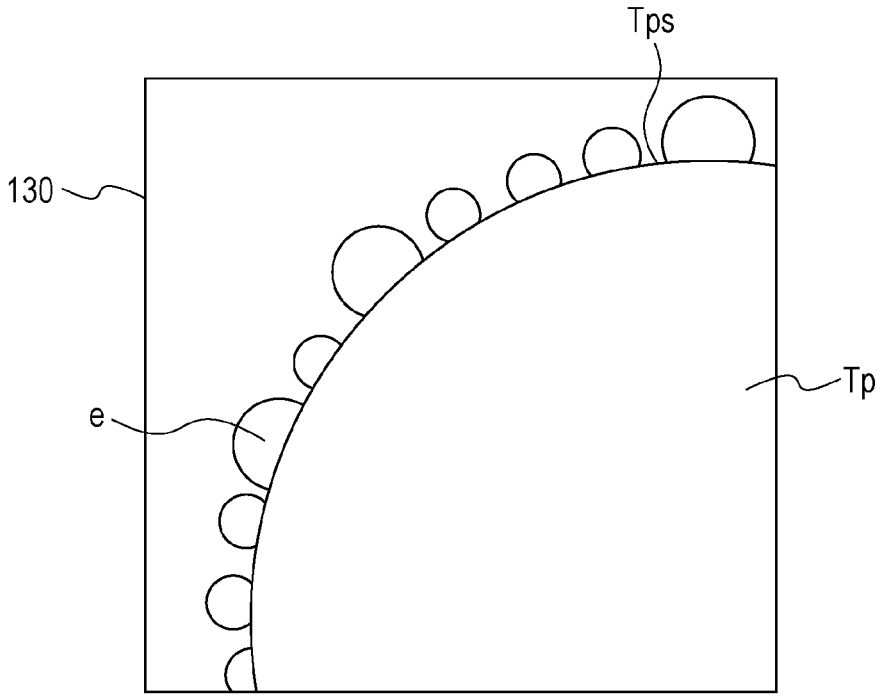
FIG. 4 is a schematic view of toner according to the exemplary embodiment 1.

A STEM image 130 in FIG. 4 shows approximately a quarter of a cross-section of a toner particle, wherein Tp denotes a toner base particle, Tps denotes the surface of the toner base particle, and e denotes protrusions. This image illustrates a cross-section of one of four quadrants of the coordinate system having the center of the cross-section of the toner particle as the origin, and the other three quadrants should symmetrically have the same cross-section.

A cross-sectional image of toner is observed, and a line is drawn along the circumference of the surface of a toner base particle. The cross-sectional image is converted into a horizontal image on the basis of the line along the circumference. In the horizontal image, the length of a line along the circumference in a portion where a protrusion and the toner base particle form a continuous interface is defined as a protrusion width w. The maximum length of the protrusion normal to the protrusion width w is defined as a protrusion diameter d. The length from the top of the protrusion in the line segment forming the protrusion diameter d to the line along the circumference is defined as a protrusion height h.

The protrusion e illustrated in FIG. 5 accounts for most of protrusions formed in toner produced by a production method according to the present exemplary embodiment described later. The protrusion e has a flat portion ep and a curved portion ec, as described later.

Figure 5:
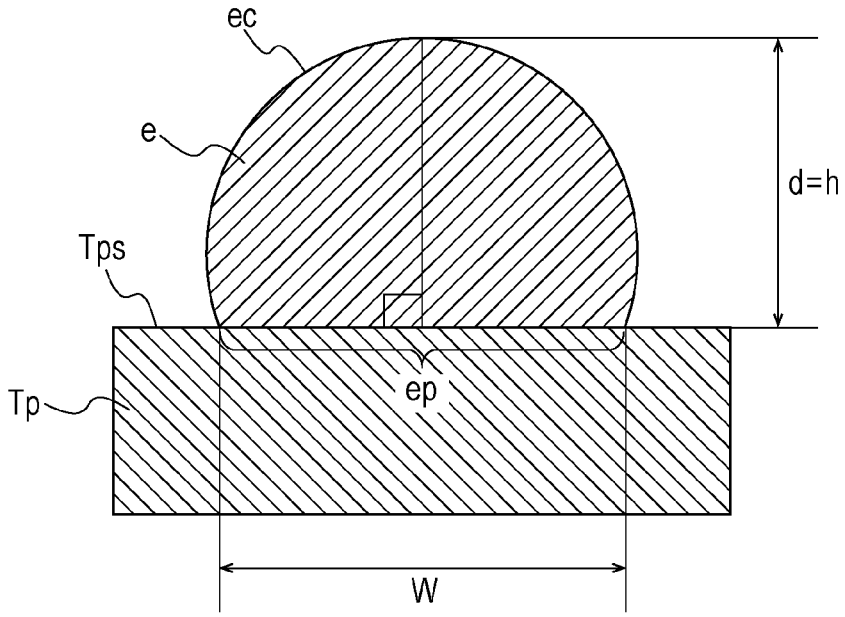
FIG. 5 is a schematic view of an organosilicon polymer in the toner according to the exemplary embodiment 1.
Figure 6:
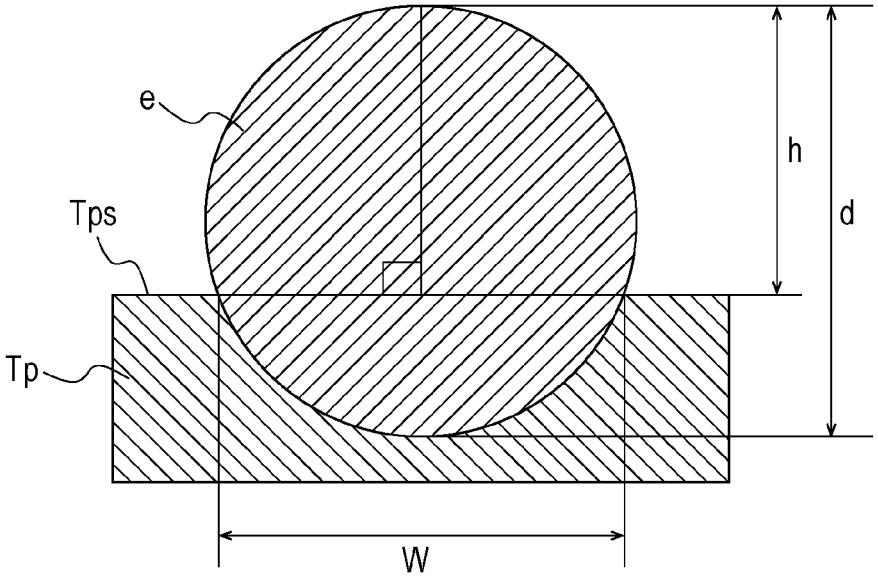
FIG. 6 is a schematic view of an organosilicon polymer in the toner according to the exemplary embodiment 1.
Figure 7:
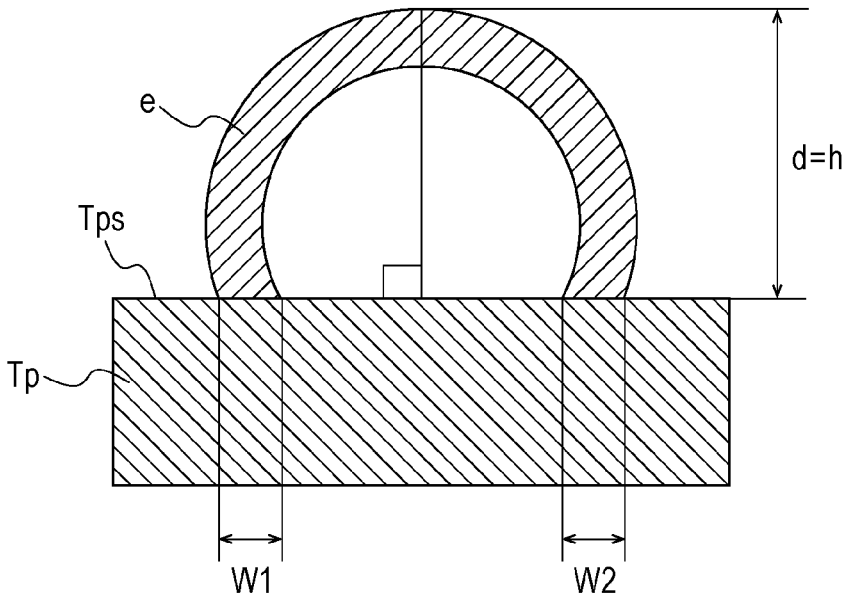
FIG. 7 is a schematic view of an organosilicon polymer in the toner according to the exemplary embodiment 1.

In FIGS. 5 and 7, the protrusion diameter d is the same as the protrusion height h. In FIG. 6, the protrusion diameter d is larger than the protrusion height h. FIG. 7 schematically illustrates the state of a fixed particle similar to a bowl-shaped particle, which is formed by breaking or dividing a hollow particle and has a hollow center. In FIG. 7, the protrusion width w is the total length of an organosilicon compound in contact with the surface of the toner base particle. More specifically, the protrusion width w in FIG. 7 is the sum of W1 and W2.

It has been found under the above conditions that an organosilicon compound protrusion with the ratio d/w of the protrusion diameter d to the protrusion width w being 0.33 or more and 0.80 or less is rarely moved, separated, or buried. More specifically, it has been found that when the number percentage P(d/w) of protrusions with a ratio d/w of 0.33 or more and 0.80 or less is 70% or more by number in protrusions with a protrusion height h of 40 nm or more and 300 nm or less, this results in high transferability for extended periods.

Protrusions of 40 nm or more probably produce spacer effects between the surface of toner base particles and a transfer member and improve transferability. On the other hand, protrusions of 300 nm or less probably produce significant effects of suppressing movement, separation, and burying in durability assessment.

It has been found that when the number percentage P(d/w) of protrusions of 40 nm or more and 300 nm or less is 70% or more by number, this results in a higher effect of suppressing the soiling of members while transferability is maintained for extended periods. P(d/w) is preferably 75% or more by number, more preferably 80% or more by number. The upper limit is preferably, but not limited to, 99% or less by number, more preferably 98% or less by number.

Values in the cross-sectional observation of toner with a scanning transmission electron microscope STEM can be determined as described below wherein the width of the horizontal image (the length of a line along the circumference of the surface of a toner base particle) is defined as a perimeter L. That is, Σw/L is preferably 0.30 or more and 0.90 or less, wherein Σw denotes the sum of the protrusion widths w of protrusions with a protrusion height h of 40 nm or more and 300 nm or less among the organosilicon polymer protrusions present in the horizontal image.

Σw/L of 0.30 or more results in higher transferability and a higher effect of suppressing the soiling of members. Σw/L of 0.90 or less results in higher transferability. Σw/L is more preferably 0.45 or more and 0.80 or less.

The fixing percentage of the organosilicon polymer in toner is preferably 80% or more by mass. At a fixing percentage of 80% or more by mass, transferability and the effect of suppressing the soiling of members can be more easily maintained in long-term use. The fixing percentage is more preferably 90% or more by mass, still more preferably 95% or more by mass. The upper limit is preferably, but not limited to, 99% or less by mass, more preferably 98% or less by mass. The fixing percentage may be controlled by the addition rate of the organosilicon compound, the reaction temperature, the reaction time, the reaction pH, and the timing of pH adjustment in the addition and polymerization of the organosilicon compound.

The protrusion height can be determined as described below to improve transferability. In the cumulative distribution of the protrusion height h of protrusions with a protrusion height h of 40 nm or more and 300 nm or less, the protrusion height h80 at a cumulative number of 80% from the smallest of the protrusion height h is preferably 65 nm or more, more preferably 75 nm or more. The upper limit is preferably, but not limited to, 120 nm or less, more preferably 100 nm or less.

In the observation of toner with a scanning electron microscope SEM, the number average diameter of the maximum protrusion diameters R of organosilicon polymer protrusions is preferably 20 nm or more and 80 nm or less, more preferably 35 nm or more and 60 nm or less. In such a range, soiling of members is less likely to occur.

The toner contains an organosilicon polymer with a structure represented by the following formula (1).

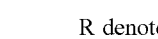

$$R—SiO_{3/2} \quad (1)$$

R denotes an alkyl group having 1 to 6 carbon atoms or a phenyl group.

In an organosilicon polymer with the structure represented by the formula (1), one of the four valence electrons of the Si atom is bonded to R, and the other three are bonded to an O atom. Two valence electrons of the O atom are bonded to Si and constitute a siloxane bond (Si—O—Si). In organosilicon polymers, two Si atoms occupy three O atoms, which is represented by $—SiO_{3/2}$. The $—SiO_{3/2}$ structure of the organosilicon polymer probably has properties similar to those of silica ($SiO_2$) composed of a large number of siloxane bonds.

In the partial structure represented by the formula (1), R may be an alkyl group having 1 to 6 carbon atoms or an alkyl group having 1 to 3 carbon atoms. Examples of the alkyl group having 1 to 3 carbon atoms include, but are not limited to, a methyl group, an ethyl group, and a propyl group. R may be a methyl group.

The organosilicon polymer can be a polycondensate of an organosilicon compound with a structure represented by the following formula (Z).

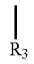

$$R_3 \quad (Z)$$

In the formula (Z), $R_1$ denotes a hydrocarbon group (an alkyl group) having 1 to 6 carbon atoms, and $R_2$, $R_3$, and $R_4$ independently denote a halogen atom, a hydroxy group, an acetoxy group, or an alkoxy group.

$R_1$ can be an aliphatic hydrocarbon group having 1 to 3 carbon atoms or a methyl group.

$R_2$, $R_3$, and $R_4$ independently denote a halogen atom, a hydroxy group, an acetoxy group, or an alkoxy group (hereinafter also referred to as a reactive group). These reactive groups undergo hydrolysis, addition polymerization, or condensation polymerization and form a cross-linked structure. An alkoxy group having 1 to 3 carbon atoms, such as a methoxy group or an ethoxy group, can be used in consideration of mild hydrolysis at room temperature and precipitation on the surface of toner base particles.

Hydrolysis, addition polymerization, or condensation polymerization of $R_2$, $R_3$, and $R_4$ can be controlled via the reaction temperature, reaction time, reaction solvent, and pH. To produce an organosilicon polymer for use in the present disclosure, one or a combination of organosilicon compounds having three reactive groups ($R_2$, $R_3$, and $R_4$) except $R_1$ in a molecule in the formula (Z) (hereinafter also referred to as a trifunctional silane) may be used.

An organosilicon polymer produced by using an organosilicon compound with the structure represented by the formula (Z) in combination with the following compound may be used, provided that the advantages of the present disclosure are not significantly reduced: an organosilicon compound having four reactive groups per molecule (tetrafunctional silane), an organosilicon compound having two reactive groups per molecule (bifunctional silane), or an organosilicon compound having one reactive group per molecule (monofunctional silane).

The organosilicon polymer content of the toner particles preferably ranges from 1.0% or more by mass and 10.0% or less by mass.

The above specific protrusions may be formed on the surface of toner particles by dispersing toner base particles in an aqueous medium to prepare a toner base particle dispersion liquid and adding an organosilicon compound to the toner base particle dispersion liquid to form the protrusions, thereby preparing a toner-particle dispersion liquid.

The toner base particle dispersion liquid is preferably adjusted to have a solid content of 25% or more by mass and 50% or less by mass. The temperature of the toner base particle dispersion liquid is preferably adjusted to 35° C. or more. The pH of the toner base particle dispersion liquid can be adjusted such that the organosilicon compound is less likely to condense. The pH at which the organosilicon compound is less likely to condense depends on the substance and is preferably within ±0.5 with respect to the pH at which the organosilicon compound is least likely to condense.

The organosilicon compound can be hydrolyzed before use. For example, the organosilicon compound is hydrolyzed in a separate container in a pretreatment. Preferably 40 parts by mass or more and 500 parts by mass or less, more preferably 100 parts by mass or more and 400 parts by mass or less, of water from which ions are removed, such as ion-exchanged water or RO water, per 100 parts by mass of the organosilicon compound is used for hydrolysis. The hydrolysis conditions preferably include a pH range of 2 to 7, a temperature range of 15° C. to 80° C., and a time range of 30 to 600 minutes.

The resulting hydrolysate and the toner base particle dispersion liquid are mixed and adjusted to the pH suitable for condensation (preferably 6 to 12 or 1 to 3, more preferably 8 to 12). The protrusions are easily formed by adjusting the amount of hydrolysate such that the amount of the organosilicon compound is 5.0 parts by mass or more and 30.0 parts by mass or less per 100 parts by mass of the toner base particles. The formation of the protrusions by condensation is preferably performed in the temperature range of 35° C. to 99° C. for 60 minutes to 72 hours.

The pH can be adjusted in two steps to control the protrusion shape on the surface of the toner particles. The protrusion shape on the surface of the toner particles can be controlled by appropriately adjusting the holding time before adjusting the pH, appropriately adjusting the holding time before adjusting the pH in the second step, and condensing the organosilicon compound. For example, holding in the pH range of 4.0 to 6.0 for 0.5 to 1.5 hours and then in the pH range of 8.0 to 11.0 for 3.0 to 5.0 hours is preferred. The protrusion shape can also be controlled by adjusting the condensation temperature of the organosilicon compound in the range of 35° C. to 80° C.

For example, the protrusion width w can be controlled by the addition amount of the organosilicon compound, the reaction temperature, and the reaction pH and the reaction time in the first step. For example, the protrusion width tends to increase with the reaction time in the first step.

The protrusion diameter d and the protrusion height h can also be controlled by the addition amount of the organosilicon polymer, the reaction temperature, and the pH in the second step. For example, the protrusion diameter d and the protrusion height h tend to increase with the reaction pH in the second step.

A specific method for producing toner is described below, but the present disclosure is not limited thereto. Toner base particles can be produced in an aqueous medium, and protrusions containing an organosilicon polymer can be formed on the surface of the toner base particles.

Toner base particles can be produced by a suspension polymerization method, a dissolution suspension method, or an emulsion aggregation method, particularly the suspension polymerization method. In the suspension polymerization method, the organosilicon polymer tends to be uniformly deposited on the surface of the toner base particles, the organosilicon polymer has high adhesiveness, and the environmental stability, the effect of inhibiting a component that reverses the amount of electrical charge, and the durability and stability thereof are improved. The suspension polymerization method is further described below.

The suspension polymerization method is a method for producing toner base particles by granulating a polymerizable monomer composition containing a polymerizable monomer capable of producing a binder resin and an optional additive agent, such as a colorant, in an aqueous medium and polymerizing the polymerizable monomer contained in the polymerizable monomer composition.

If necessary, a release agent and another resin may be added to the polymerizable monomer composition. After the completion of the polymerization process, the produced particles can be washed by a known method and collected by filtration. The temperature may be increased in the latter half of the polymerization process. To remove unreacted polymerizable monomers or by-products, the dispersion medium may be partly evaporated from the reaction system in the latter half of the polymerization process or after the completion of the polymerization process.

The toner base particles thus produced can be used to form organosilicon polymer protrusions by the above method.

The toner may contain a release agent. Examples of the release agent include, but are not limited to, petroleum waxes and their derivatives, such as paraffin waxes, microcrystalline waxes, and petrolatum, montan waxes and their derivatives, Fischer-Tropsch waxes and their derivatives, polyolefin waxes and their derivatives, such as polyethylene and polypropylene, natural waxes and their derivatives, such as carnauba wax and candelilla wax, higher aliphatic alcohols, fatty acids, such as stearic acid and palmitic acid, and acid amides, esters, and ketones thereof, hydrogenated castor oil and its derivatives, plant waxes, animal waxes, and silicone resin.

The derivatives include oxides, block copolymers with vinyl monomers, and graft modified products. The releasing agents may be used alone or in combination. The release agent content is preferably 2.0 parts by mass or more and 30.0 parts by mass or less per 100 parts by mass of the binder resin or a polymerizable monomer forming the binder resin.

A polymerization initiator may be used in the polymerization of the polymerizable monomer. The amount of polymerization initiator to be added preferably ranges from 0.5 to 30.0 parts by mass per 100 parts by mass of the polymerizable monomer. A polymerization initiator may be used alone, or a plurality of polymerization initiators may be used in combination.

A chain transfer agent may be used in the polymerization of the polymerizable monomer to control the molecular weight of a binder resin constituting the toner base particles. The preferred addition amount ranges from 0.001 to 15.000 parts by mass per 100 parts by mass of the polymerizable monomer.

A crosslinking agent may be used in the polymerization of the polymerizable monomer to control the molecular weight of a binder resin constituting the toner base particles. The preferred addition amount ranges from 0.001 to 15.000 parts by mass per 100 parts by mass of the polymerizable monomer.

When an aqueous medium is used in the suspension polymerization, the following dispersion stabilizers can be used for particles of the polymerizable monomer composition: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. The following organic dispersants may be used: poly(vinyl alcohol), gelatin, methylcellulose, methylhydroxypropylcellulose, ethylcellulose, a carboxymethylcellulose sodium salt, and starch. Commercially available nonionic, anionic, and cationic surfactants can also be used.

The toner may contain any colorant, such as a known colorant.

The colorant content preferably ranges from 3.0 to 15.0 parts by mass per 100 parts by mass of the binder resin or a polymerizable monomer capable of forming the binder resin.

A charge control agent, such as a known charge control agent, can be used in the production of toner. The amount of charge control agent to be added preferably ranges from 0.01 to 10.00 parts by mass per 100 parts by mass of the binder resin or polymerizable monomer.

The toner particles may be directly used as toner. If necessary, an organic or inorganic fine powder may be externally added to the toner particles. The organic or inorganic fine powder preferably has a particle size of one tenth or less the weight-average particle diameter of the toner particles in terms of durability when added to the toner particles.

Examples of the organic or inorganic fine powder include:

(1) flowability imparting agents: silica, alumina, titanium oxide, carbon black, and fluorocarbon, (2) abrasives: metal oxides (for example, strontium titanate, cerium oxide, alumina, magnesium oxide, and chromium oxide), nitrides (for example, silicon nitride), carbides (for example, silicon carbide), and metal salts (for example, calcium sulfate, barium sulfate, and calcium carbonate), (3) lubricants: fluoropolymer powders (for example, vinylidene fluoride and polytetrafluoroethylene) and fatty acid metal salts (for example, zinc stearate and calcium stearate), and (4) charge control particles: metal oxides (for example, tin oxide, titanium oxide, zinc oxide, silica, and alumina) and carbon black.

The organic or inorganic fine powder may be subjected to surface treatment to improve the flowability of the toner and uniformize the charging of the toner. Examples of treatment agents for hydrophobic treatment of the organic or inorganic fine powder include unmodified silicone varnishes, modified silicone varnishes, unmodified silicone oils, modified silicone oils, silane compounds, silane coupling agents, organosilicon compounds, and organotitanium compounds. These treatment agents may be used alone or in combination.

In the present exemplary embodiment, silica particles are externally added as an external additive to the toner particles. This is added externally to improve the transfer efficiency of the toner when a toner image is primarily transferred from the photosensitive drums 1*a* to 1*d* to the intermediate transfer belt 10.

Figure 8:
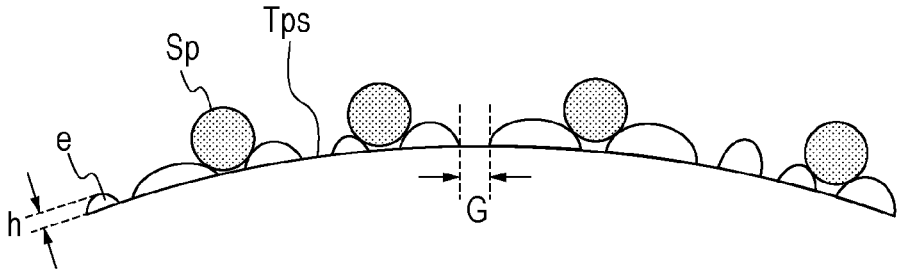
FIG. 8 is a schematic view of an external additive added to the toner according to the exemplary embodiment 1.

FIG. 8 is a schematic view of an external additive added to the toner particles in the present exemplary embodiment and is a schematic enlarged view of the surface of the toner particles. As illustrated in FIG. 8, in the toner particles of the present exemplary embodiment, silica particles Sp are externally added as an external additive to the surface Tps of the toner base particles on which a large number of organosilicon polymer protrusions e are formed.

The distance G between adjacent protrusions e on the surface Tps of the toner base particles in FIG. 8 (hereinafter referred to as the protrusion distance G) can be determined with a scanning transmission electron microscope (STEM) or a scanning probe microscope (SPM). The SPM has a probe, a cantilever for supporting the probe, and a displacement measuring device for detecting the bending of the cantilever and can be used to observe the surface profile of a sample by scanning and detecting an atomic force (attractive force or repulsive force) between the probe and the sample.

A protrusion distance G larger than a silica particle Sp between protrusions results in the silica particle Sp coming into contact with the surface Tps of the toner base particles. The number average of the protrusion distances G can therefore be smaller than the number-average particle size of the silica particles Sp.

The protrusions e with a height h larger than the particle size of the silica particles Sp prevent the silica particles Sp from coming into contact with the photosensitive drums 1*a* to 1*d*. The number average of the protrusion heights h can therefore be smaller than the number-average particle size of the silica particles Sp.

Whether or not the protrusions e contain the organosilicon polymer can be determined by a combination of elemental analysis with a scanning electron microscope (SEM) and elemental analysis by energy dispersive X-ray analysis (EDS).

[Coating Layer of Cleaning Blade]

The organosilicon polymer of the present exemplary embodiment is characteristically transferred from the toner base particles when the toner is collected from the intermediate transfer belt 10 by the blade 16*a*. This is because the collected toner base particles become dense and rub against each other near the blade 16*a*, and the friction causes the organosilicon polymer to be transferred from the toner base particles.

The organosilicon polymer is characteristically soft and easily deformed. Thus, the organosilicon polymer transferred from the toner base particles can be compressed and stretched under a certain pressure. Thus, the organosilicon polymer transferred from the toner base particles near the blade 16*a* is pressed between the blade 16*a* and the intermediate transfer belt 10 and extends on the surface of the blade 16*a*.

In the present exemplary embodiment, the organosilicon polymer in the toner is transferred from the toner base particles, is extended between the blade 16*a* and the intermediate transfer belt 10 in the blade nip portion Nb, and is located on the surface of the blade 16*a*. This reduces the abrasion of the blade 16*a* due to contact between the silica particles and the blade 16*a*. This will be described in detail below.

Figure 9A:
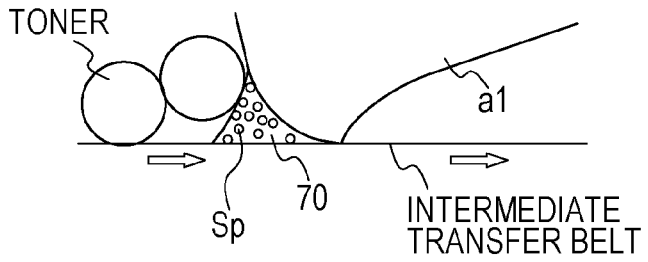
FIGS. 9A to 9D are schematic views of the formation of a coating layer in the exemplary embodiment 1.
Figure 9B:
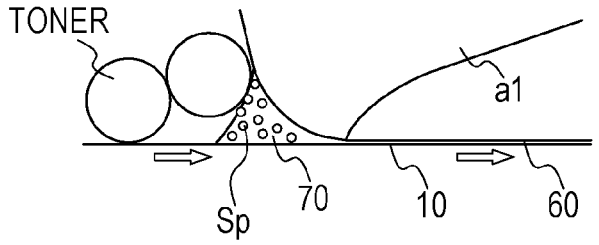
Figure 9C:
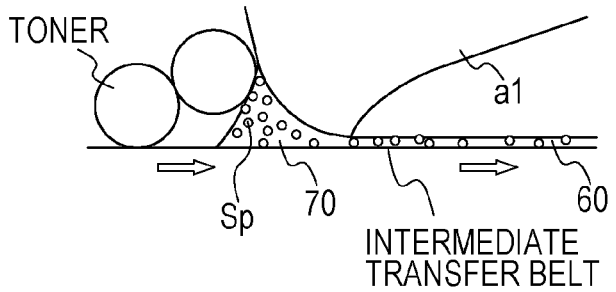
Figure 9D:
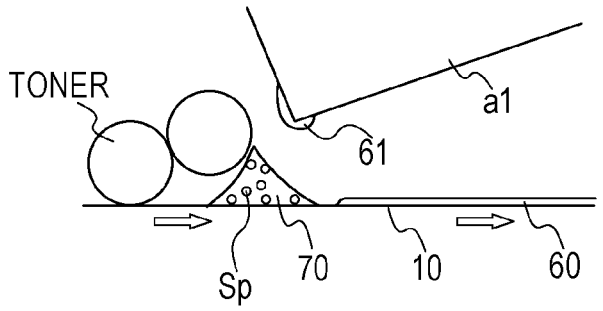

FIG. 9A is an enlarged schematic view of the blade nip portion Nb on a relatively smooth intermediate transfer belt. FIG. 9B is an enlarged schematic view of the blade nip portion Nb of the present exemplary embodiment on the intermediate transfer belt 10 having a rougher surface than the intermediate transfer belt illustrated in FIG. 9A. FIG. 9C is an enlarged schematic view of the blade nip portion Nb on an intermediate transfer belt having a rougher surface than the intermediate transfer belt 10 of the present exemplary embodiment. FIG. 9D is an enlarged schematic view of the blade nip portion Nb in the present exemplary embodiment and is a schematic view of the adhesion of the organosilicon polymer to the blade 16*a*.

As illustrated in FIGS. 9A to 9C, the front edge of the elastic portion a1 of the blade 16*a* is curled in the belt conveying direction due to frictional force caused by contact with the intermediate transfer belt 10. A blocking layer 70 is formed upstream of the elastic portion a1 in the belt conveying direction. The blocking layer 70 contains the organosilicon polymer transferred from the toner to the intermediate transfer belt 10 and an external additive (silica particles in the present exemplary embodiment) if added to the toner particles. The blocking layer 70 prevents the toner from passing through the blade nip portion Nb.

In the present exemplary embodiment, the blade 16*a* is in contact with the intermediate transfer belt 10 at a pressure of 50 gf/cm. This pressure is defined as a linear pressure applied to the contact position between the intermediate transfer belt 10 and the blade 16*a* and is measured at the contact position between the intermediate transfer belt 10 and the blade 16*a* with a film pressure measuring system (trade name: PINCH, manufactured by Nitta Corporation). The linear pressure is calculated by first measuring the total pressure at the contact position with the film pressure measuring system and dividing the measured total pressure by the contact length of the blade 16*a*. The contact length of the blade 16*a* in the present exemplary embodiment (the length of the blade 16*a* in contact with the intermediate transfer belt 10 in the width direction of the intermediate transfer belt 10) is 245 mm.

After residual toner on the intermediate transfer belt 10 is collected by the blade 16*a*, the organosilicon polymer transferred from the surface of the toner base particles remains near the blade nip portion Nb and forms the blocking layer 70. The organosilicon polymer in the blocking layer 70 is pressed under the pressure of the blade 16*a* and is stretched in the blade nip portion Nb. The organosilicon polymer thus extended comes into contact with each other and is flatten in the blocking layer 70.

As illustrated in FIGS. 9A to 9C, the intervening state of the blocking layer 70 near the blade nip portion Nb differs depending on the surface roughness of the intermediate transfer belt.

The intermediate transfer belt 10 illustrated in FIG. 9B has a rougher surface than the intermediate transfer belt illustrated in FIG. 9A and more specifically has recesses and protrusions (not shown) on its surface. The surface roughness of the intermediate transfer belt 10 is described in detail later. The elastic portion a1 of the blade 16*a* follows the movement of the intermediate transfer belt 10 while changing its form according to the surface profile including recesses and protrusions of the intermediate transfer belt 10. Thus, with the movement of the intermediate transfer belt 10, the blocking layer 70 enters recesses and passes between the elastic portion a1 and the intermediate transfer belt 10.

When the blocking layer 70 passes through the blade nip portion Nb, the organosilicon polymer in the blocking layer 70 comes into contact with and adheres to the blade 16*a* and forms a coating layer 61 between the intermediate transfer belt 10 and the blade 16*a*, as illustrated in FIG. 9D. FIG. 9D is a schematic view of the coating layer 61 adhering to the surface of the blade 16*a* and is a schematic view of the surface of the blade 16*a* separated from the intermediate transfer belt 10. The reason why the organosilicon polymer in the blocking layer 70 adheres to the surface of the blade 16*a* is described later.

The amount of the organosilicon polymer in the blocking layer 70 passing through the blade nip portion Nb increases with the surface roughness of the intermediate transfer belt 10. As illustrated in FIG. 9C, the amount of the blocking layer 70 passing through the blade nip portion Nb on the intermediate transfer belt illustrated in FIG. 9C having a larger surface roughness than the intermediate transfer belt 10 illustrated in FIG. 9B is larger than that in FIG. 9B. On the intermediate transfer belt with the large surface roughness in FIG. 9C, not only the organosilicon polymer but also the silica particles Sp pass through the blade nip portion Nb and form a thin film 60.

In the present exemplary embodiment, the silica particles Sp are externally added to the toner base particles as an external additive. As described above, the externally added silica particles Sp can improve transfer efficiency. Such fine particles passing through the blade nip portion Nb, however, may rub against the surface of the blade 16*a* and wear the blade 16*a*. This may cause faulty cleaning due to the abrasion of the blade 16*a*.

Even when the external additive is large enough to be blocked by the blade 16*a*, the external additive may come into contact with the blade 16*a*, rub against and scrape the blade 16*a*, and cause the abrasion of the blade 16*a*. As described above, when the blade 16*a* comes into contact with and is rubbed with the external additive, faulty cleaning due to abrasion may occur.

In the present exemplary embodiment, to suppress friction caused by contact between the blade 16*a* and the external additive silica particles Sp, the organosilicon polymer in the blocking layer 70 is interposed between the blade 16*a* and the silica particles Sp to reduce the abrasion of the blade 16*a*. To this end, in the present exemplary embodiment, the size of the external additive silica particles Sp, the surface roughness of the intermediate transfer belt 10, and the size of the organosilicon polymer on the surface of the toner base particles are controlled.

More specifically, making the average particle diameter Rk of the external additive silica particles Sp larger than the surface roughness Rz of the intermediate transfer belt 10 can prevent the silica particles Sp from passing through the blade nip portion Nb and prevent the state illustrated in FIG. 9C.

Furthermore, forming the coating layer 61 illustrated in FIG. 9D can suppress friction caused by contact between the blade 16*a* and the silica particles Sp and improve the durability of the blade 16*a*. More specifically, making the surface roughness Rz of the intermediate transfer belt 10 larger than the average particle diameter Ry of the organosilicon polymer enables the organosilicon polymer contained in the blocking layer 70 to pass through the blade nip portion Nb and form the thin film 60 and the coating layer 61. The formation of the coating layer 61 by the adhesion of the organosilicon polymer to the blade 16*a* is described in detail later.

In the present exemplary embodiment, to improve transfer efficiency and reduce the occurrence of faulty cleaning, the setting conditions of the average particle diameter Rk of the silica particles Sp, the surface roughness Rz of the intermediate transfer belt 10, and the average particle diameter Ry of the organosilicon polymer are summarized as the following formula (3).

$$Rk > Rz > Ry \quad (3)$$

Next, the average particle diameter Rk of the silica particles Sp, the surface roughness Rz of the intermediate transfer belt 10, and the average particle diameter Ry of the organosilicon polymer are described in detail below.

The surface roughness of the intermediate transfer belt 10 is defined by a 10-point roughness average Rz in the thickness direction of the intermediate transfer belt 10 (hereinafter simply referred to as a surface roughness Rz). The surface roughness Rz of the intermediate transfer belt 10 in the present exemplary embodiment was measured with a surface roughness tester (trade name: Surfcom 1500SD, manufactured by Tokyo Seimitsu Co., Ltd.). The measurement conditions included a measurement length of 1.25 mm, a cut-off wavelength of 0.25 mm, and a measurement reference length of 0.25 mm in the belt width direction perpendicular to the belt conveying direction.

The surface roughness Rz of the intermediate transfer belt 10 can be such that the organosilicon polymer passes through the blade nip portion Nb, whereas the silica particles Sp do not pass through the blade nip portion Nb.

The organosilicon polymer forms the protrusions e on the surface Tps of the toner base particles, and the protrusion height h can be considered to be the organosilicon polymer particle size. Thus, the number average [nm] of the protrusion heights h can be the average particle diameter Ry of the organosilicon polymer. Thus, the average particle diameter Ry of the organosilicon polymer can be determined by measuring the protrusion height h as described above.

In the present exemplary embodiment, the surface roughness Rz of the intermediate transfer belt 10 is adjusted by polishing the surface of the intermediate transfer belt 10 such that the surface roughness Rz satisfies the formula (3). More specifically, in the present exemplary embodiment, the surface of the intermediate transfer belt 10 is buffed such that the surface roughness Rz of the intermediate transfer belt 10 satisfies the formula (3). The intermediate transfer belt 10 may be polished by any method, provided that the formula (3) is satisfied.

Figure 10:
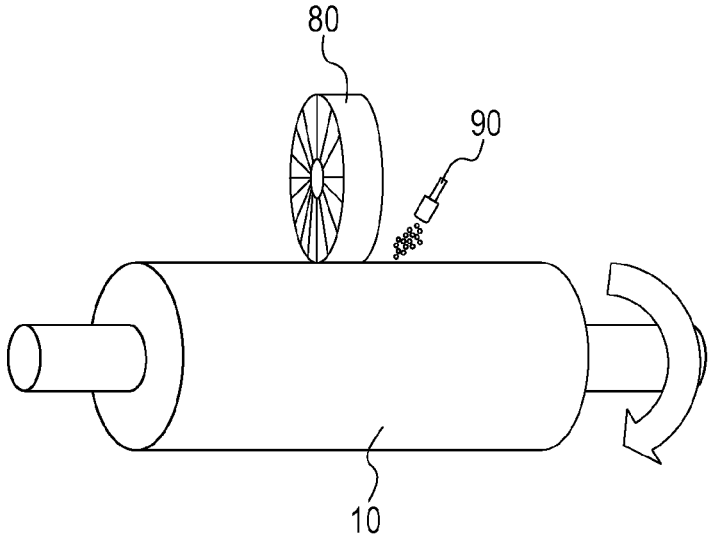
FIG. 10 is a schematic view of the adjustment of the surface roughness of the intermediate transfer belt according to the exemplary embodiment 1.

In the process of polishing the intermediate transfer belt 10, a cotton buff is used, an abrasive with a particle size in the range of 1 to 5 μm was used for rough polishing, and an alumina powder with a particle size in the range of 0.05 to 0.5 μm is used for finish polishing. FIG. 10 is a schematic view of the process of polishing the intermediate transfer belt 10 in the present exemplary embodiment.

As illustrated in FIG. 10, first, an abrasive is sprayed from a spray nozzle 90 over the surface of the intermediate transfer belt 10. While a buffing roll 80 is rotated under a small pressure, the buffing roll 80 is moved for finish polishing in the rotation axial direction of the intermediate transfer belt 10. Rough polishing is also performed in the same manner. The rotational speed of the buffing roll 80 preferably ranges from 500 to 1000 rpm, the travel speed of the buffing roll 80 preferably ranges from 0.5 to 1 m/min, and the rotational speed of a base bearing the intermediate transfer belt 10 preferably ranges from 100 to 1000 rpm.

The abrasive used for buffing may be a known abrasive, for example, alumina, silicon boride, emery, ZnO, MgO, $SnO_2$, $Fe_2O_3$, CrO, $Cr_2O_3$, SiC, or a diamond powder.

In the present exemplary embodiment, the average particle diameter Rk of the external additive silica particles Sp is 120 nm, and the average particle diameter Ry of the organosilicon polymer is 40 nm. Thus, in the present exemplary embodiment, the surface roughness Rz of the intermediate transfer belt 10 is preferably 40 nm or more and less than 120 nm. Provided that the surface roughness Rz of the intermediate transfer belt 10 is in this range, various settings for buffing (the number of rotation, travel speed, time, etc.) may be appropriately determined.

<Adhesion of Organosilicon Polymer to Blade 16*a*>

Next, the principle of adhesion of the organosilicon polymer passing through the blade nip portion Nb to the blade 16*a* in the present exemplary embodiment is described below.

In the present exemplary embodiment, the surface layer 81 of the intermediate transfer belt 10 is formed of an acrylic resin, and the elastic portion a1 of the blade 16*a* in contact with the intermediate transfer belt 10 is formed of a urethane rubber, which is an elastic material. A particulate resin may be dispersed in the surface layer 81 formed of the acrylic resin. In such a case, the size of resin particles to be dispersed can be appropriately changed to control the surface roughness of the intermediate transfer belt 10.

The measurement of the adhesion strength between the acrylic resin constituting the surface layer 81 of the intermediate transfer belt 10 and the organosilicon polymer and the adhesion strength between the urethane rubber constituting the elastic portion a1 of the blade 16*a* and the organosilicon polymer is described below.

The adhesion strength between the organosilicon polymer and the object can be measured with a scanning probe microscope (hereinafter referred to as an SPM). The scanning probe microscope (SPM) has a probe, a cantilever for supporting the probe, and a displacement measuring device for detecting the bending of the cantilever and can be used to observe the surface profile of a sample by scanning and detecting an atomic force (attractive force or repulsive force) between the probe and the sample.

The adhesion strength of the organosilicon polymer used in the present exemplary embodiment on the intermediate transfer belt 10 or the blade 16*a* was measured with the SPM. More specifically, a cantilever with a contact silica portion was used as a lever, and after the cantilever was pressed against the intermediate transfer belt 10 by a predetermined pressing force, a force necessary for detaching the cantilever from the intermediate transfer belt 10 was measured. The organosilicon polymer was considered to have properties similar to silica from the viewpoint of its composition, and the adhesion strength between the cantilever with the silica portion and the object was measured as the adhesion strength between the organosilicon polymer and the object. The adhesion strength Fi between the organosilicon polymer and the intermediate transfer belt 10 was measured by this method. The adhesion strength Fc between the blade 16*a* and the organosilicon polymer was also measured by the method.

The predetermined pressing force for pressing the cantilever against the object in the measurement of the adhesion strength can be the force for pressing the blade 16*a* against the intermediate transfer belt 10. In the present exemplary embodiment, the pressing force F for pressing the blade 16*a* against the intermediate transfer belt 10 is 50 gf/cm, and the contact width of the probe of the SPM is 10 nm. Thus, the pressing force of the cantilever for measuring adhesion strength can be 500 nN. Furthermore, to compare the magnitude relationship of adhesion strength, the adhesion strength at a preferred pressing force may be estimated from the result measured at a pressing force that is not the preferred pressing force. In the present exemplary embodiment, the latter method was used to estimate the magnitude relationship between the adhesion strength Fi and the adhesion strength Fc at 500 nN from the results measured at pressing forces of 50 and 100 nN.

According to the above measurement method, the adhesion strength between the silica and the urethane rubber, that is, the adhesion strength Fc between the organosilicon polymer and the blade 16*a* was 7 nN at a pressing force of 50 nN and 12 nN at a pressing force of 100 nN. The adhesion strength between the silica and the acrylic resin, that is, the adhesion strength Fi between the organosilicon polymer and the intermediate transfer belt 10 was 5 nN at a pressing force of 50 nN and 6 nN at a pressing force of 100 nN. Thus, in the measurement at a pressing force of either 50 or 100 nN, the adhesion strength Fc was higher than the adhesion strength Fi. Furthermore, it can be inferred from the above measurement results that the adhesion strength Fc is 52 nN and the adhesion strength Fi is 14 nN at a pressing force of 500 nN. Thus, it is found from these results that the adhesion strength between the blade 16*a* and the organosilicon polymer is higher than the adhesion strength between the intermediate transfer belt 10 and the organosilicon polymer.

Thus, due to the difference in adhesion strength of the organosilicon polymer between the blade 16*a* made of the urethane rubber and the intermediate transfer belt 10 made of the acrylic resin, the organosilicon polymer can adhere to the blade 16*a*. In the present exemplary embodiment, the acrylic resin is used as a material of the intermediate transfer belt 10, and the urethane rubber is used as a material of the blade 16*a*. However, the blade 16*a* and the intermediate transfer belt 10 may be made of any material, provided that the adhesion strength Fc between the blade 16*a* and the organosilicon polymer is higher than the adhesion strength Fi between the intermediate transfer belt 10 and the organosilicon polymer.

<Operation and Advantages>

Next, the advantages of the present exemplary embodiment are described below with reference to Comparative Examples 1 and 2 in which the surface roughness Rz of the intermediate transfer belt does not satisfy the formula (3) of the present exemplary embodiment. Comparative Examples 1 and 2 are substantially the same as the present exemplary embodiment except that the surface roughness Rz of the intermediate transfer belt does not satisfy the formula (3). In the following description, therefore, the components described in the present exemplary embodiment are denoted by the same reference numerals and letters and are not described again.

In Comparative Example 1, the surface roughness Rz of the intermediate transfer belt is 0.3 μm, which is larger than the average particle diameter Rk of the silica particles Sp, which is 120 nm. Thus, in Comparative Example 1, Rz>Ry in the formula (3) is satisfied, but Rk>Rz is not satisfied. In Comparative Example 2, the surface roughness Rz of the intermediate transfer belt is 0.02 μm, which is smaller than the average particle diameter Ry of the organosilicon polymer, which is 40 nm. Thus, in Comparative Example 2, Rk>Rz in the formula (3) is satisfied, but Rz>Ry is not satisfied.

Table 1 shows the evaluation results of the presence or absence of abrasion of the blade 16*a* and the presence or absence of faulty cleaning in the present exemplary embodiment and Comparative Examples 1 and 2.

The presence or absence of abrasion of the blade 16*a* was determined by measuring the abrasion loss of the elastic portion a1 of the blade 16*a* after feeding 20*k* sheets of the transfer material P. More specifically, after feeding 20*k* sheets of the transfer material P, the contact state of the blade 16*a* with the intermediate transfer belt 10 was released, the elastic portion a1 was observed under a microscope, and the abrasion loss was measured in comparison with the inspection result of the elastic portion a1 before feeding the sheets.

The microscope used to measure the abrasion loss is a confocal microscope (OPTELICS, manufactured by Lasertec Corporation). The measurement conditions included an observation area of 100 μm square, a measurement wavelength of 546 nm, and a scan frequency of 0.1 μm in a direction perpendicular to the contact position of the blade 16*a*. The abrasion loss of the blade 16*a* used in this evaluation was the maximum value in the longitudinal direction of the blade 16*a*. In Table 1, after 20 k sheets of the transfer material P were fed, an abrasion loss of 0.3 μm or more of the elastic portion a1 was judged to be the presence of abrasion, and an abrasion loss of less than 0.3 μm of the elastic portion a1 was judged to be the absence of abrasion.

The cleaning performance was evaluated in terms of the level of faulty cleaning when an image was formed after 10 k sheets of the transfer material P were fed. In Table 1, "○" represents the occurrence of no faulty cleaning, "Δ" represents the occurrence of acceptable slight faulty cleaning, and "x" represents the occurrence of unacceptable faulty cleaning.

TABLE 1

Evaluation results of abrasion and cleaning of blade 16a at different surface roughnesses Rz

| | Surface roughness Rz [μm] | Presence or absence of abrasion | Cleaning |
|---|---|---|---|
| Exemplary embodiment 1 | 0.07 | Absent | ○ |
| Comparative example 1 | 0.3 | Present | x |
| Comparative example 2 | 0.02 | Present | Δ |

In the exemplary embodiment 1, the surface roughness Rz of the intermediate transfer belt 10 is 0.07 μm, which satisfies Rk>Rz>Ry of the formula (3). In this embodiment, as described with reference to FIGS. 9B and 9D, friction caused by contact between the silica particles Sp and the blade 16*a* could be suppressed, the abrasion of the blade 16*a* was not observed, and the cleaning performance was also good.

In Comparative Example 1, the surface roughness Rz of the intermediate transfer belt is 0.3 μm, which is larger than the average particle diameter Rk of the silica particles Sp, and does not satisfy Rk>Rz of the formula (3). Thus, as described with reference to FIG. 9C, the silica particles Sp incorporated into the blocking layer 70 passed through the blade nip portion Nb and caused the abrasion of the blade 16*a* due to friction caused by contact between the blade 16*a* and the silica particles Sp. Furthermore, the abrasion of the blade 16*a* caused faulty cleaning due to the toner passing through the blade nip portion Nb.

In Comparative Example 2, the surface roughness Rz of the intermediate transfer belt is 0.02 μm, which is smaller than the average particle diameter Ry of the organosilicon polymer, and does not satisfy Rz>Ry of the formula (3). Thus, as described with reference to FIG. 9A, the organosilicon polymer in the blocking layer rarely passed through the blade nip portion Nb and rarely formed the thin film 60 and the coating layer 61. This caused the abrasion of the blade 16*a* due to friction between the blade 16*a* and the intermediate transfer belt. When 10 k sheets of the transfer material P were fed, acceptable faulty cleaning was observed. In Comparative Example 2, the coat layer 61 was not substantially formed, and continuous paper feeding will increase the abrasion of the blade 16*a* and cause faulty cleaning.

As described above, in the present exemplary embodiment, the addition of the silica particles Sp as an external additive to the toner base particles can reduce the adhesion strength between the photosensitive drums 1*a* to 1*d* and the toner and improve transfer efficiency. In the present exemplary embodiment, setting the surface roughness Rz of the intermediate transfer belt 10 within the range satisfying the formula (3) enables the formation of the coating layer 61 and can prevent the silica particles Sp from passing through the blade nip portion Nb. This can reduce the abrasion of the blade 16*a* and reduce the occurrence of faulty cleaning. Thus, the present exemplary embodiment can improve toner transfer efficiency and reduce the occurrence of faulty cleaning.

The surface roughness Rz of the intermediate transfer belt in the present exemplary embodiment refers to the surface roughness measured in the belt width direction perpendicular to the belt conveying direction. At any surface roughness measured in any direction that satisfies the formula (3) of the present exemplary embodiment, it is possible to form the coating layer 61, reduce the abrasion of the blade 16*a*, and have the advantages described in the present exemplary embodiment. When the surface roughness Rz in the belt width direction satisfies the formula (3), the coating layer 61 can be formed over the entire region of the blade 16*a* in the belt width direction.

In the present exemplary embodiment, the surface roughness Rz of the intermediate transfer belt 10 was adjusted by polishing. However, the surface roughness Rz of the intermediate transfer belt 10 may be adjusted by another method. For example, the surface roughness Rz of the intermediate transfer belt 10 may be adjusted by the curing conditions of a curable resin in the formation of the surface layer 81 of the intermediate transfer belt 10. More specifically, the surface of the intermediate transfer belt 10 can be roughened by decreasing radiation energy to cure the surface layer 81 and increasing the surface curing time. Alternatively, the surface of the intermediate transfer belt 10 can be roughened by stopping energy beam irradiation before the surface layer is completely cured to provide a time period in which the surface of the intermediate transfer belt 10 is not cured. For example, an intermediate transfer belt with a surface roughness Rz of approximately 100 nm can be obtained by stopping irradiation after the surface layer 81 is irradiated with an energy beam for approximately 60 seconds to satisfy the formula (3) in a method of forming the surface layer 81 in the present exemplary embodiment.

Figure 11:
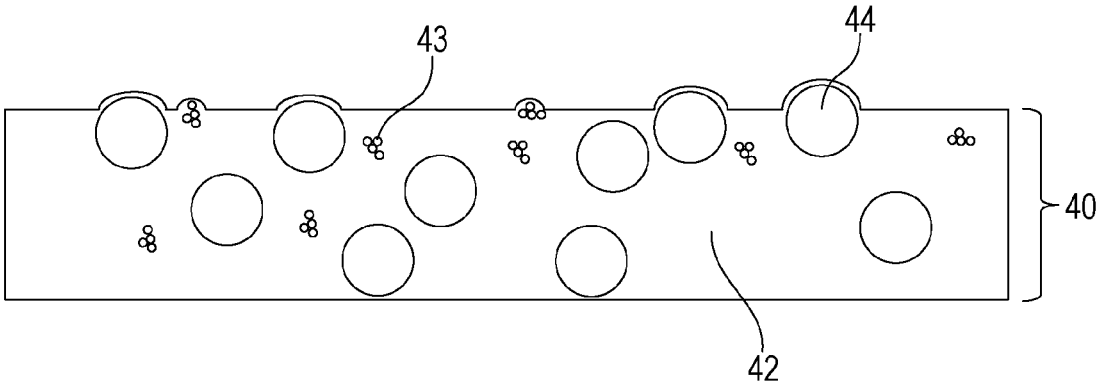
FIG. 11 is a schematic view of the adjustment of the surface roughness of the intermediate transfer belt in a modification example of the exemplary embodiment 1.

The surface roughness Rz of the intermediate transfer belt 10 may also be adjusted by the addition of particles to the surface layer 81 of the intermediate transfer belt 10. FIG. 11 is a schematic view of a modification example of adjusting the surface roughness Rz of an intermediate transfer belt by adding particles to a surface layer 40 of the intermediate transfer belt. This modification example is almost the same as the exemplary embodiment 1 except that the particles are added to the surface layer 40 to adjust the surface roughness Rz. Thus, the components described in the exemplary embodiment 1 are denoted by the same reference numerals and letters and are not described again.

As illustrated in FIG. 11, the surface layer 40 of the intermediate transfer belt in the modification example contains a solid lubricant 44 of PTFE particles with a particle size of 200 nm and a conducting agent 43 at a controlled blend ratio. The surface roughness Rz of the intermediate transfer belt can be desirably adjusted by controlling the dispersed state of the particles added to the surface layer 40 such that the solid lubricant 44 (PTFE particles) and the conducting agent 43 are aggregated or exposed. In the present modification example, the ratio of the solid lubricant 44 to the conducting agent 43 is adjusted so that the surface roughness Rz of the intermediate transfer belt is approximately 100 nm to satisfy the formula (3) as in the exemplary embodiment 1.

More specifically, in the present modification example, 20 parts by weight of the solid lubricant 44 and 20 parts by weight of the conducting agent 43 are mixed with 100 parts by weight of an acrylic resin, which is a base material 42 of the surface layer 40, to satisfy the condition of the formula (3). These amounts are not particularly limited and may be altered to satisfy the formula (3). For example, to decrease the surface roughness Rz, the amount of particles in the surface layer 40 may be decreased, and to increase the surface roughness Rz, the amount of particles may be increased, or a filler may be mixed as particles with a large particle size.

Whether the surface roughness Rz of the intermediate transfer belt satisfies the formula (3) can be determined by measuring the surface roughness Rz as described in the exemplary embodiment 1.

Exemplary Embodiment 2

In the exemplary embodiment 1, the surface roughness Rz of the intermediate transfer belt 10 is adjusted by dispersing resin on the surface of the intermediate transfer belt 10 made of the acrylic resin. The exemplary embodiment 2 is different from the exemplary embodiment 1 in that the surface roughness Rz is adjusted by forming grooves on the surface of an intermediate transfer belt 210 as a structure for allowing the extended organosilicon polymer to pass between the intermediate transfer belt 210 and the blade 16*a*. The exemplary embodiment 2 is substantially the same as the exemplary embodiment 1 except that the grooves are formed on the surface of the intermediate transfer belt 210. Thus, the components described in the exemplary embodiment 1 are denoted by the same reference numerals and letters and are not described again.

Figure 12:
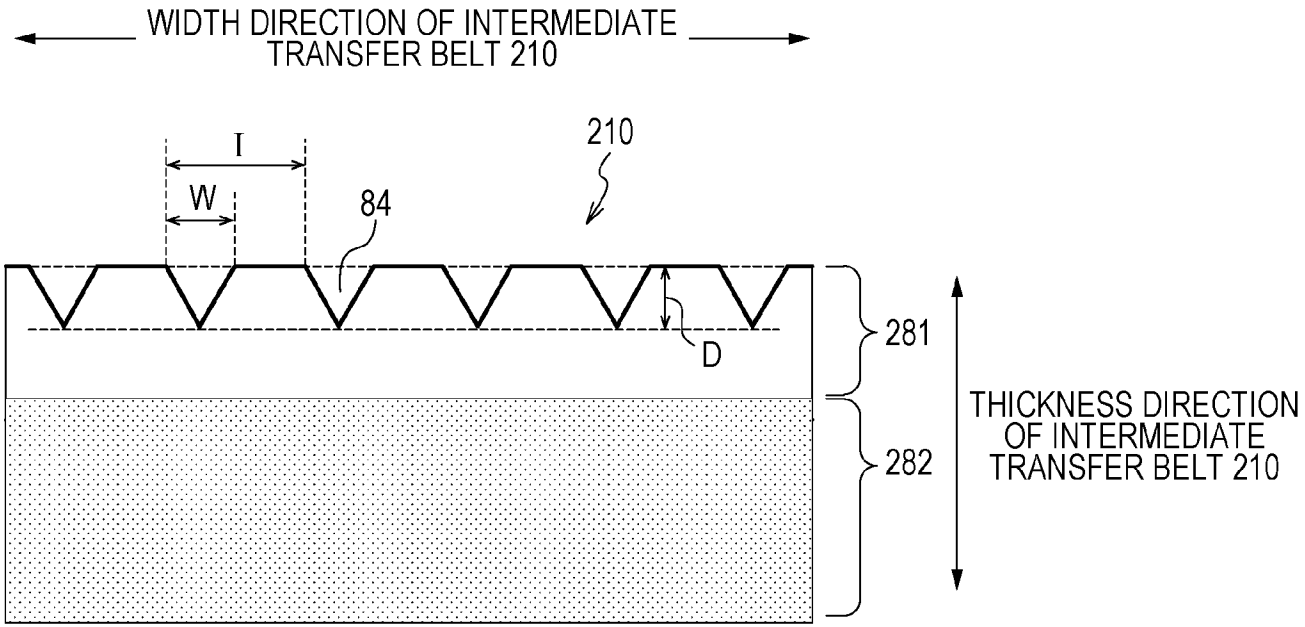
FIG. 12 is a schematic view of an intermediate transfer belt according to an exemplary embodiment 2.
Figure 13A:
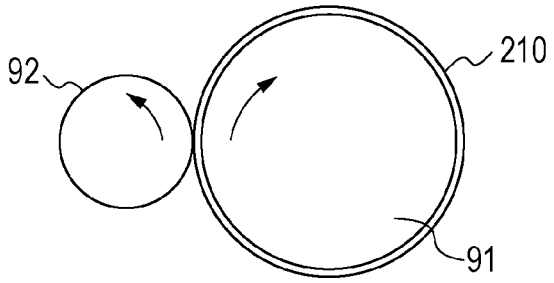
FIGS. 13A to 13C are schematic views of a method for producing the intermediate transfer belt according to the exemplary embodiment 2.
Figure 13B:
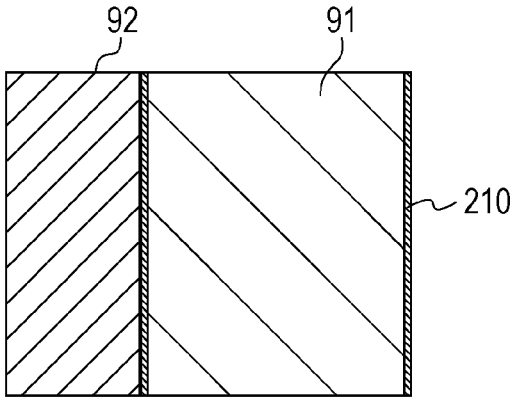
Figure 13C:
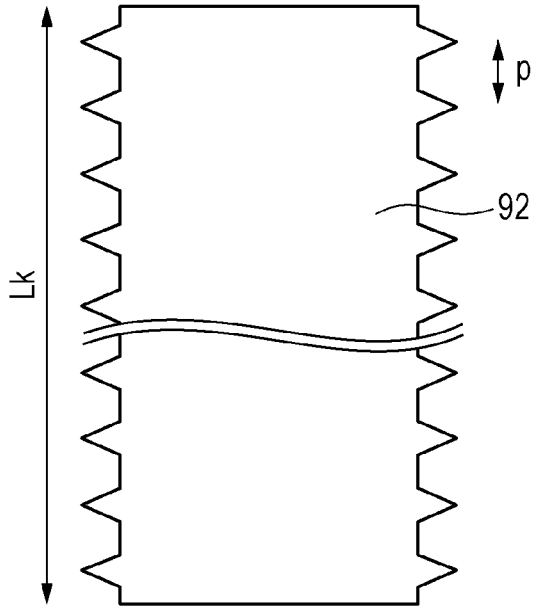

FIG. 12 is a schematic view of the intermediate transfer belt 210 in the present exemplary embodiment. FIGS. 13A to 13C are schematic views of a method for producing the intermediate transfer belt 210 in the present exemplary embodiment.

As illustrated in FIG. 12, the intermediate transfer belt 210 of the present exemplary embodiment has a base layer 282 and a surface layer 281, and grooves 84 are formed on the surface of the surface layer 281. The grooves 84 in the present exemplary embodiment are defined by the interval I as the distance between adjacent grooves in the width direction of the intermediate transfer belt 210, the groove width W as the width of each opening of the grooves 84, and the groove depth D as the depth of each opening of the grooves 84 in the thickness direction of the intermediate transfer belt 210. In the present exemplary embodiment, the interval I is 20 μm, the groove width W is 2 μm, and the groove depth D is 2 μm.

The groove width W is preferably less than half the average particle diameter of 8 μm of the toner in order to prevent the toner from pathing through. The surface layer 281 has a thickness of 3 μm, and the grooves 84 does not reach the base layer 282 and are formed only in the surface layer 281. In the present exemplary embodiment, the grooves 84 are present in the entire circumference of the intermediate transfer belt 210 along the movement direction (belt conveying direction) of the intermediate transfer belt 210.

The amount of extended organosilicon polymer to adhere to the blade 16*a* can be increased or decreased by increasing or decreasing the number of the grooves 84 on the intermediate transfer belt 210. The interval I is preferably 10 μm or more and 100 μm or less, particularly preferably 10 μm or more and 20 μm or less from the viewpoint of sufficiently ensuring the contact time between the blade 16*a* and the grooves 84.

Next, a method of forming the grooves 84 on the intermediate transfer belt 210 is described below. The grooves 84 can be formed by a known method, such as polishing, cutting, or imprinting. The intermediate transfer belt 210 with the grooves on its surface in the present exemplary embodiment can be produced by appropriately selecting and using one of such forming methods. In particular, imprinting utilizing the photocurability of an acrylic resin serving as a base material of a microfabricated surface has low processing costs and high productivity.

Furthermore, in addition to the process of providing the grooves 84 on the surface of the intermediate transfer belt 210 to adjust the surface roughness Rz, for example, polishing with a lapping film (Lapika #2000 (trade name), manufactured by KOVAX Corporation) may be used to form a surface profile on the intermediate transfer belt 210. Fine abrasive particles uniformly dispersed in the lapping film can form a uniform profile without deep scratches or uneven polishing and can form grooves by polishing.

Imprinting in the present exemplary embodiment is described in detail below with reference to FIGS. 13A to 13C. FIG. 13A is a schematic view of an imprinting apparatus viewed from above in the cylindrical axis direction of the intermediate transfer belt 210. FIG. 13B is a schematic cross-sectional view of the imprinting apparatus in the direction parallel to the cylindrical axis of the intermediate transfer belt 210. FIG. 13C is a schematic view of the shape of a die 92 in the imprinting apparatus.

When the grooves 84 are formed by imprinting, as illustrated in FIG. 13A, first, the intermediate transfer belt 210 having the surface layer 281 on the base layer 282 is press-fitted to a core 91 (227 mm in diameter, made of carbon tool steel). The entire surface of the press-fitted intermediate transfer belt 210 with a longitudinal width of 250 mm is processed with a cylindrical die 92 50 mm in diameter and 250 mm in length.

To form the grooves 84 in the intermediate transfer belt 210, the die 92 is heated with a heater (not shown) to a temperature of 130° C., which is higher by 5° C. to 15° C. than the glass transition temperature of poly(ethylene naphthalate). While the heated die 92 abuts against the core 91, the core 91 is rotated once at a circumferential velocity of 264 mm/s, and then the die 92 is separated from the core 91. While the core 91 is rotated, the die 92 rotates with the rotation of the core 91. In the present exemplary embodiment, surface profile processing is performed as described above to form the grooves 84 on the surface layer 281 of the intermediate transfer belt 210.

To form the grooves 84 as in the present exemplary embodiment, as illustrated in FIG. 13C, a die 92 with a length Lk is used. The die 92 has triangular protrusions on its surface at regular intervals p parallel to the circumferential direction of the cylinder. In the present exemplary embodiment, the intervals p are 20 μm, and the length Lk is 250 mm. The triangular protrusions are formed by cutting so as to have a bottom length of 2.0 μm and a height of 2.0 μm. The grooves 84 can be formed in the intermediate transfer belt 210 by imprinting with the die 92, as described above.

The grooves of the intermediate transfer belt 210 in the present exemplary embodiment are further described below. First, toner in a deep part of excessively deep grooves cannot be cleaned off, and therefore the groove depth D is preferably 4 μm or less. When the grooves are too shallow, the grooves are difficult to process, and the blade 16*a* easily follows the surface of the intermediate transfer belt 210, making it difficult to improve the durability of the blade 16*a*. The groove depth D is therefore preferably 0.05 μm or more.

The grooves 84 form a space between the intermediate transfer belt 210 and the blade 16*a*. The organosilicon polymer passing through the space can adhere to the blade 16*a* and form the coating layer 61 between the intermediate transfer belt 210 and the blade 16*a* as in the exemplary embodiment 1. The surface roughness Rz of the intermediate transfer belt 210 in the present exemplary embodiment is in the same range as in the exemplary embodiment 1.

Figure 14:
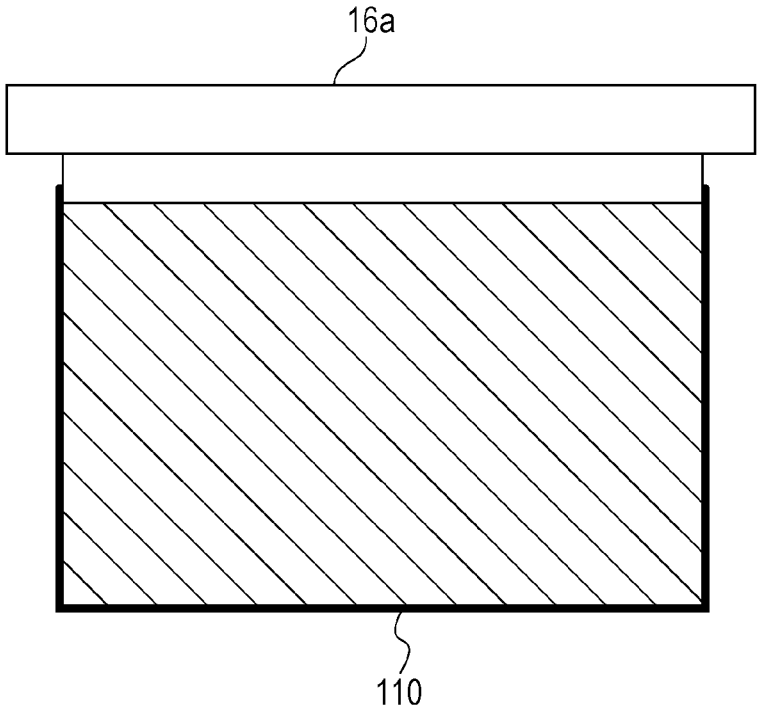
FIG. 14 is a schematic view of an intermediate transfer belt according to a modification example of the exemplary embodiment 2.

In a modification example of the present exemplary embodiment, for uniform adhesion of the organosilicon polymer to the blade 16*a*, as illustrated in FIG. 14, inclined grooves inclined from the rotational direction may be formed in the rotational direction of an intermediate transfer belt 110. In this modification example, the contact points between the grooves and the blade 16*a* move in the longitudinal direction (in the width direction of the intermediate transfer belt 110) with the movement of the intermediate transfer belt 110. Consequently, the space formed by the grooves over the entire longitudinal length of the blade 16*a* comes into contact with the blade 16*a*, and the organosilicon polymer can adhere uniformly to the blade 16*a*.

Thus, the formation of the grooves 84 on the intermediate transfer belt 210 and the surface roughness Rz of the intermediate transfer belt 210 in the same range as in the exemplary embodiment 1 can have the same advantages as in the exemplary embodiment 1.

Figure 15A:
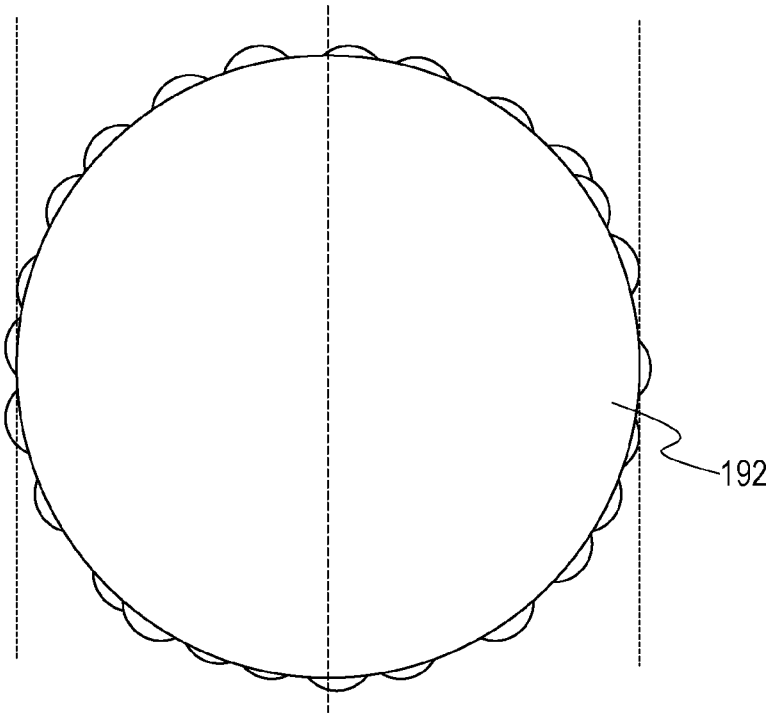
FIGS. 15A to 15C are schematic views of an intermediate transfer belt according to a modification example of the exemplary embodiment 2 and a method for producing the intermediate transfer belt.
Figure 15B:
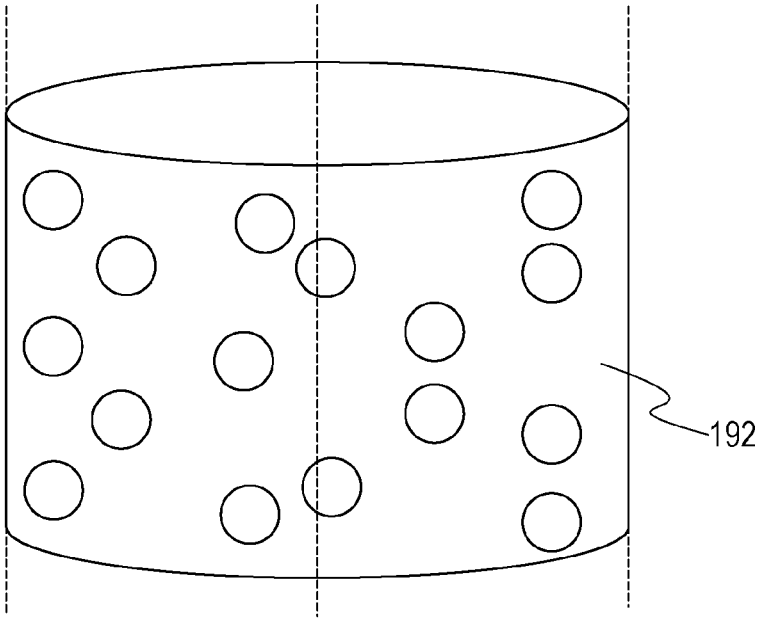
Figure 15C:
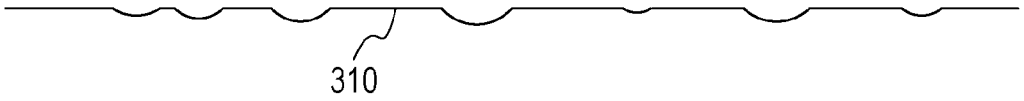

Although the intermediate transfer belt 210 is provided with the grooves along the belt conveying direction in the present exemplary embodiment, the surface profile of the intermediate transfer belt 210 is not limited to the grooves, provided that the surface roughness Rz can satisfy the formula (3) of the exemplary embodiment 1. For example, as illustrated in FIGS. 15A and 15B, a press die 192 for forming dimples on an intermediate transfer belt 310 may be used. Using the pressing die 192, as illustrated in FIG. 15C, dimples can be formed on the surface of the intermediate transfer belt 310. The formation of the dimples on the surface of the intermediate transfer belt 310 so that the surface roughness Rz satisfies the formula (3) as in the exemplary embodiment 1 can have the same advantages as in the exemplary embodiment 1.

Although the image-forming apparatus 100 of the intermediate transfer system including the intermediate transfer belt has been described in the exemplary embodiments 1 and 2, the present disclosure is not limited thereto. The exemplary embodiments can also be applied to an image-forming apparatus of a direct transfer system including a conveying belt that electrostatically bears and conveys the transfer material P. When a contact member, such as a cleaning blade, is used as a cleaning member to collect residual toner on a conveying belt, an image-forming apparatus of the direct transfer system can also have the same advantages as the exemplary embodiments by utilizing the configuration of the exemplary embodiments.

The present disclosure can improve toner transfer efficiency and reduce the occurrence of faulty cleaning when residual toner on a belt is collected by a cleaning blade that abuts against the belt.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-060757 filed Mar. 30, 2020, which is hereby incorporated by reference herein in its entirety.

What is claimed is:

1. An image-forming apparatus comprising:

an image-bearing member configured to bear a toner image;

a developing device, which includes a storage portion configured to accommodate toner and a developing member configured to develop a latent image formed on the image-bearing member with the toner;

a movable endless belt facing the image-bearing member; and a collecting device with a cleaning blade that can abut against the belt and with which residual toner on the belt can be collected, wherein the toner accommodated in the developing device contains toner base particles and an organosilicon polymer on a surface of the toner base particles, an external additive included in toner in the storage portion, is configured to move together with the toner from the developing member toward the image-bearing member, and a surface roughness of an outer peripheral surface of the belt against which the cleaning blade abuts, is larger than an average particle diameter of the organosilicon polymer, and is smaller than an average particle diameter of the external additive.

2. The image-forming apparatus according to claim 1, wherein the organosilicon polymer has a structure represented by the following formula (1), $$R—SiO_{3/2} \quad (1)$$

wherein R denotes an alkyl group having 1 to 6 carbon atoms or a phenyl group.

3. The image-forming apparatus according to claim 1, wherein the organosilicon polymer forms a protrusion on the surface of the toner base particles, and the protrusion is configured to be transferred from the surface of the toner base particles along with movement of the belt at a position where the toner is configured to be collected by the cleaning blade.

4. The image-forming apparatus according to claim 1, wherein adhesion strength between a surface of the cleaning blade and the organosilicon polymer is greater than adhesion strength between a surface of the belt and the organosilicon polymer.

5. The image-forming apparatus according to claim 4, wherein the surface of the belt is formed of an acrylic resin.

6. The image-forming apparatus according to claim 4, wherein the surface of the cleaning blade is formed of a urethane rubber.

7. The image-forming apparatus according to claim 1, wherein the belt has a plurality of grooves formed on the outer peripheral surface along a movement direction of the belt arranged in a width direction of the belt perpendicular to the movement direction.

8. The image-forming apparatus according to claim 7, wherein the grooves are located at intervals of 10 μm or more and 100 μm or less in the width direction and have a depth of 0.05 μm or more in a thickness direction of the belt perpendicular to the movement direction and the width direction.

9. The image-forming apparatus according to claim 7, wherein the belt is composed of a plurality of layers, including a base layer with a largest thickness and a surface layer formed on the outer peripheral surface, and the grooves are formed in the surface layer.

10. The image-forming apparatus according to claim 1, wherein the belt is an intermediate transfer belt, and a toner image borne on the image-bearing member is configured to be primarily transferred from the image-bearing member to the intermediate transfer belt at a position where the image-bearing member abuts against the intermediate transfer belt, and is configured to be then secondarily transferred from the intermediate transfer belt to a transfer material.

11. The image-forming apparatus according to claim 10, further comprising:

a secondary transfer member, which abuts against the outer peripheral surface of the intermediate transfer belt, wherein the toner image primarily transferred from the image-bearing member to the intermediate transfer belt is configured to be secondarily transferred to the transfer material at a position where the secondary transfer member abuts against the intermediate transfer belt, and the collecting device is located downstream of a position where the secondary transfer member abuts against the intermediate transfer belt and upstream of a position where the image-bearing member abuts against the intermediate transfer belt in a movement direction of the intermediate transfer belt.

12. The image-forming apparatus according to claim 1, wherein the belt is a conveying belt configured to convey a transfer material, and a toner image borne on the image-bearing member is configured to be transferred to the transfer material conveyed by the conveying belt.

* * * * *